US007819781B1

(12) United States Patent
Maldonado

(10) Patent No.: US 7,819,781 B1
(45) Date of Patent: Oct. 26, 2010

(54) METHODS AND APPARATUS FOR IMPROVED ISOLATED MUSCULATURE TRAINING

(75) Inventor: Brian Maldonado, 1091 16th Ave. SE., Apt 1, Minneapolis, MN (US) 55414

(73) Assignee: Brian Maldonado, Minneapolis, MN (US)

( * ) Notice: Subject to any disclaimer, the term of this patent is extended or adjusted under 35 U.S.C. 154(b) by 0 days.

(21) Appl. No.: 12/533,646

(22) Filed: Jul. 31, 2009

(51) Int. Cl.
*A63B 21/068* (2006.01)
*A63B 22/16* (2006.01)
*A63B 21/04* (2006.01)
*A63B 69/16* (2006.01)

(52) U.S. Cl. ..... 482/62; 482/95; 482/130; 482/132; 482/141; 482/142

(58) Field of Classification Search ..... 482/51, 482/52, 57, 62, 92, 95, 96, 130–132, 139–142, 482/148, 907
See application file for complete search history.

(56) References Cited

U.S. PATENT DOCUMENTS 2,906,532 A * 9/1959 Echols ..... 482/131
5,356,362 A * 10/1994 Becker et al. ..... 482/142
6,309,331 B1 * 10/2001 Raymond ..... 482/148
6,440,045 B1 * 8/2002 Gaston ..... 482/140
6,461,284 B1 * 10/2002 Francavilla ..... 482/142
6,547,706 B1 * 4/2003 Chek ..... 482/148
6,669,611 B2 * 12/2003 Raymond ..... 482/148
6,689,026 B2 * 2/2004 Almada ..... 482/140
7,476,189 B2 * 1/2009 Hale ..... 482/142
7,674,216 B1 * 3/2010 Bolling ..... 482/142
2003/0120188 A1 * 6/2003 Kusumi ..... 601/115
2005/0079964 A1 * 4/2005 Francavilla ..... 482/142
2005/0245370 A1 * 11/2005 Boland ..... 482/130
2007/0207906 A1 * 9/2007 Blaum ..... 482/146
2009/0215597 A1 * 8/2009 Fernandez ..... 482/146
2009/0325770 A1 * 12/2009 Baschnagel ..... 482/142

* cited by examiner

*Primary Examiner*—Loan Thanh
*Assistant Examiner*—Victor K Hwang
(74) *Attorney, Agent, or Firm*—Patterson Thuente; Christensen Pedersen, P.A.

(57) ABSTRACT

Devices and methods providing for improved training of isolated regions of the human physiological system are disclosed and described herein. The devices and methods provide isolated training of muscle groups that may be transferrable to the sport of cycling or other athletic activities. An exercise apparatus is disclosed to enable training. In an embodiment, the exercise apparatus includes a front portion adapted to provide a vertically supported hand support assembly. The apparatus further includes a back portion adapted to be coupled to the front portion. The back portion is constructed to present an exercise support member with at least one exercise support surface adapted to receive an exercise ball such that a user may grip at least one gripping member presented by the hand support assembly and position him or herself upon the exercise ball to perform exercises according to various aspects of the invention described herein.

19 Claims, 19 Drawing Sheets

METHODS AND APPARATUS FOR IMPROVED ISOLATED MUSCULATURE TRAINING

FIELD OF THE INVENTION

The present invention relates generally to exercise training equipment. More specifically, the present invention relates to a training apparatus to allow isolated training of an athlete's musculature to improve performance.

BACKGROUND OF THE INVENTION

A significant challenge in bicycle training is for a cyclist to move as efficiently as possible while maximizing power output. Often, it is difficult for cyclists to learn proper technique involving precise functional movement of the upper trunk, lower trunk, and pelvis. The bones and joints can be thought of as scaffolding, forming a system of levers in the human body, while the muscular system provides force and allows for motion by the levers. The scaffolding, or the body segments and bones, can be moved by at least two opposing sets of muscles. The performance of preferred movement of any muscle group requires precise contraction from an agonist muscle and relative relaxation of an antagonist group of muscles. Co-contraction of muscles, or concurrent contraction and relaxation of opposing muscles, results in an inability to perform precise functional movement. As such, to maximize performance in cycling or any exercise, it is advantageous to train the musculature to contract and relax as efficiently as possible. To improve an athlete's ability to perform preferred movements, a user should remain relatively relaxed and apply precise movement that the task demands. For cycling, proper functional movement may enable a cyclist to remain relaxed, performing a pedaling action quite freely, and enabling the cyclist to make beneficial adjustments in cadence and intensity by means of specific movements of the shoulders, upper trunk, lower trunk, and pelvis.

The bicycling community, including authors of cycling books, reviewers of the cycling literature, coaches and athletes, have placed physiological training, for example pedal based training, and aerodynamics at center stage with regard to bicycle riding and performance standards. The common perception is that any movements of the shoulders, trunk, or the pelvis are wasteful and represent a detriment to riding efficiency. However, maintaining the pelvis fixed on the saddle naturally leads to undesired muscle co-contractions in an attempt to counteract pedal reaction forces. Thus, the above-mentioned perception is in error, as it leads to ineffective co-contractions of opposing muscle sets.

The bicycling community fails to recognize the importance of the shoulders, upper trunk, lower trunk, and pelvis in the application of force to pedals and the crankarms of a bicycle. Biomechanical publications generally assume a cyclists pelvis is fixed on a saddle to simplify biomechanical calculations. Because of this misunderstanding, physiologists typically disregard the contribution of the trunk and pelvis towards performance, since the cyclist's legs account for the bulk of physiological requirements. As a result, known training programs merely reinforce a cyclists pre-existing skill level and do not typically lead to rapid improvement.

To be efficient, a cyclist must manage pedal reaction forces that result from both the downstroke and upstroke of a pedaling motion. These rotational moments are in the same direction and therefore additive. If a cyclist's pelvis sits passively on a saddle, then once the athlete exceeds a certain performance threshold, these movements will become unstable and inefficient. For example, when the only thing that keeps a cyclist's pelvis seated on a saddle is body weight, then instability will likely result due to bouncing of the pelvis on the saddle. The physiological approach to training does nothing to address rotational induced instability. A cyclist will typically expend inordinate energy in a futile attempt to maintain rigidity and stability, with no benefit in terms of bicycle propulsion.

One scientific publication illustrates that the pelvis does indeed exhibit an elliptical path of progression. ("Accuracy Assessment of Methods for Determining Hip Movement in Seated Cycling", R. R. Neptune and M. L. Hull, J. Biomechanics Vol. 28, No. 4, pp. 423-437, 1995). The authors conclude that the movement of the pelvis, from a single experimental subject, contributed significant mechanical energy to a pedal stroke. The authors made no reference regarding the integrated role of the shoulders, upper trunk, lower trunk and pelvis, nor any allusion regarding skill in the sport of cycling beyond stating that a bony marker on the pelvis traced an elliptical path.

As discussed above, scientific and cycling communities have failed to recognize that cycling-specific, well-coordinated, graceful, and precise movements punctuate superior performance. As a result, known devices and methods of bicycle training that focus only on physiological training, such as pure cycling or pedal-based training, are insufficient to provide a cyclist with an ability to improve motion of the shoulders, upper trunk, lower trunk, and pelvis. As such, there exists a need for improved methods and devices for cycling training to enhance rider stability and improve rider efficiency.

SUMMARY OF THE INVENTION

The invention described herein is a training apparatus to improve cycling specific muscle memory while training the same muscles to be used in the desired physical condition for the execution of the skills involved in the sport of cycling.

In an embodiment, an exercise device for isolated training of one or more musculature systems of the human body is disclosed and described herein. The exercise device includes a front portion having a hand support assembly. The exercise device also includes an exercise support member including a first surface and a second surface and having an angle adjustment bar at a first end. The exercise device further includes a base including four sides, a vertical support member adapted to receive a second end of the exercise support member, and an angle plate at a top surface of the base. The angle plate has a plurality of divots constructed to receive the angle adjustment bar. The base includes at least one coupling interface presented at each of the four sides of the base. Each coupling interface is constructed to interface with a corresponding portion of the hand support assembly. The exercise device is constructed to enable a user to balance on an exercise ball supported by the exercise support member and grip the hand support unit to perform exercises.

In an embodiment, a method of performing exercises with the exercise device of the present invention is disclosed and described herein. The method includes selecting from among a plurality of sides of an exercise device base so as to select an angular orientation of the exercise support member relative to the hand support assembly. A selected side of the base of the exercise support member is coupled to the front portion. In addition, the method includes selecting from a first surface and a second surface of the exercise support member to select an exercise surface contour of the exercise support member. A first side of the exercise support member is disposed at a vertical support unit of the base. The method further includes selecting an inclination angle of the exercise support member with respect to the base by selecting a divot of a plurality of divots presented in an angle plate at an upper surface of the base. An angle adjustment bar presented at a second side of the exercise support member is disposed in the selected divot of the plurality of divots. The method additionally includes positioning an exercise ball on the exercise support surface, and performing exercises while positioned upon the exercise ball and gripping at least one bicycle-style hand grip presented by the hand support assembly.

A kit for enabling isolated training of one or more muscles of a user's body is disclosed and described herein. The kit includes an exercise ball adapted to allow a user to balance upon to perform exercises. The kit includes at least one exercise band constructed to provide resistance while exercising. The kit also includes the exercise apparatus, described herein.

While some illustrative embodiments of the invention have been described above, it is, of course, understood that various modifications will be apparent to those of ordinary skill in the art. Such modifications are within the spirit and scope of the invention, which is limited and defined only by the appended claims.

BRIEF DESCRIPTION OF THE DRAWINGS

The invention may be more completely understood in consideration of the following detailed description of various embodiments of the invention in connection with the accompanying drawings, in which.

Figure 1:
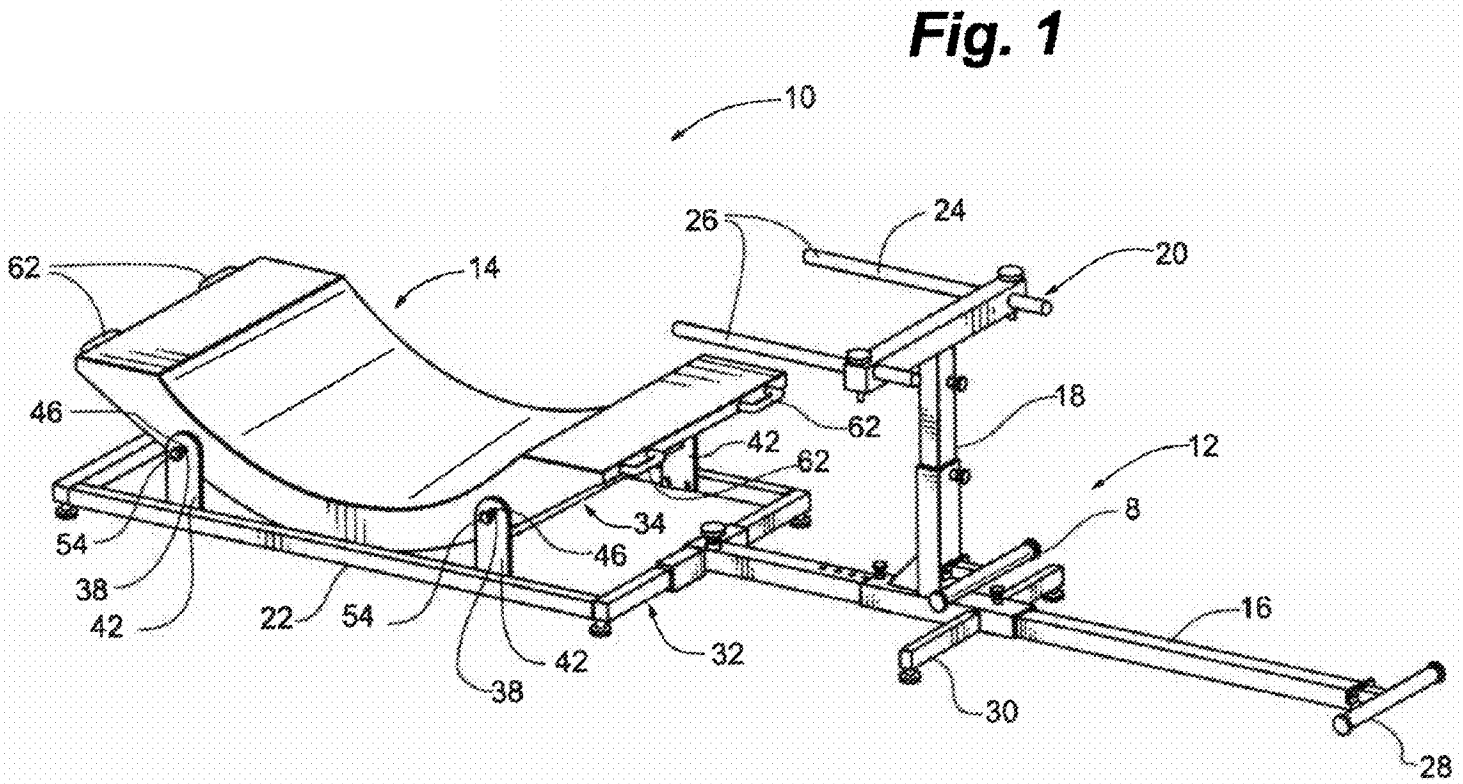
FIG. 1 illustrates an angled top-down perspective view of an exercise apparatus according to a first embodiment.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENTS

The invention is applicable to men and women cyclists and cyclists of any height and weight. Suitable adjustments or modifications of the invention for any cyclist will be readily apparent to those skilled in the art.

Exercise Apparatus

In various embodiments described herein, an exercise apparatus 10, 110 is described. As described in greater detail below, exercise apparatus 10, 110 is adapted to provide a structure for purposes of performing various physiologically beneficial movements. In some of these exercises, a user balances upon an exercise ball while gripping one or more gripping members of exercise apparatus 10, 110 to perform exercises.

FIGS. 1-5 illustrate generally an exercise apparatus according to one embodiment. Exercise apparatus 10 includes front support assembly 12 and exercise support surface 14 supported by base 22. Front support assembly 12 includes ground support unit 16, vertical support member 18, and handrail unit 20. Front support assembly 12 is adapted to provide a user with a stable mechanism to grip during exercise.

Front support assembly 12 provides an interface with a floor or other surface upon which front support assembly 12 is situated. Handrail unit 20 is secured at a vertical position via vertical support member 18.

Main stability bar 16, back stability bar 32, and front stability bar 28 are arranged to provide support for vertical support member 18 and handrail unit 20. Main stability bar 16 provides support in a longitudinal dimension. Main bar 16 extends between front and back stability bars 30, 32, which provide support in a lateral dimension.

As shown, vertical support member 18 is adapted to interface with and be secured to main stability bar 16. Each of hand support assembly 20 and stability members 30-32 may be permanently, semi-permanently, or removeably secured to main stability bar 16. As depicted, back stability member 32 may be formed integral to base 22, and an end of main stability bar 16 proximal to back stability member 32 may be secured to back stability member 32. In embodiments not depicted, back stability member 32 may be formed independent of base 22, and secured to base by various means known in the art.

Stability members 30, 32 and/or main stability bar 16 may include additional support mechanisms adapted to interface with a floor or other surface upon which exercise apparatus 10 is placed to allow for individualized height adjustment and/or to provide cushion or shock absorbance. Such mechanisms are known and familiar to those having skill in the art.

Vertical unit 18 provides support for hand support assembly 20 with respect to main stability bar 16. Vertical unit 18 may be secured to and extend vertically from ground support unit 16. Vertical unit 18 may be adjustable to different heights to accommodate a particular user's physical dimensions, to allow a user to perform a variety of exercises, or to allow a user to vary an intensity of one or more exercises. For this purpose, vertical unit 18 may adapted to accept posts of different heights, or may include telescoping members (not shown) adapted to allow for adjustment to different heights.

Vertical unit 18 may further be longitudinally adjustable with respect to main stability bar 16. Vertical unit 18 may be releaseably secured to main stability bar 16 to allow for easy adjustment of a longitudinal position of vertical unit 18. A longitudinal position may be secured by one or more pop pins as commonly used to secure a position of exercise and other equipment.

Handrail assembly 20 may be adapted to be secured by various means to vertical unit 18 and includes one or more gripping means for a user to grip during exercise. The gripping means may include handrails 24 and 26. Handrails 24 and 26 may be constructed to be substantially similar to a bicycle handlebar, to simulate cycling for improvement of cycling movements.

Exercise apparatus 10 may include one or more additional attachments members such as attachment members 8 and 28. Attachment member 8 is shown secured to a front or back side of vertical unit 18 oriented perpendicular to a length of vertical unit 18 and parallel to stability bars 30 and 32. Similarly, front attachment member 28 may be secured to main stability bar 16. Attachment members 8 and 28 may be adapted to receive one or more attachment apparatuses, such as exercise bands or resistance bands.

Figure 4:
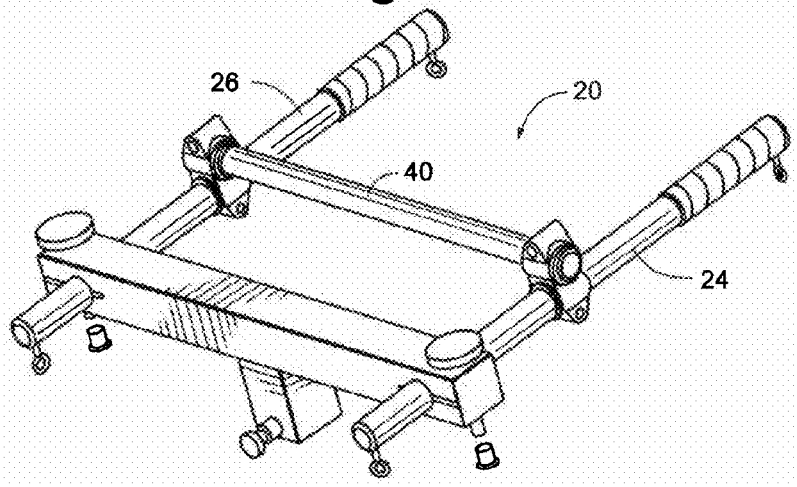
FIG. 4 illustrates a top-down perspective view of a hand support assembly of an exercise apparatus according to a first embodiment.

FIG. 4 illustrates another embodiment of handrail assembly 20. Handrail assembly 20 includes cross bar 40 secured to handrail 24 and handrail 26. Cross bar 40 may serve as an additional grip for performing exercises using apparatus 10. Cross bar 40 may also be constructed to receive additional gripping members, such as commercially available "aerobars." Cross bar 40 may also provide additional stability for handrail assembly 20.

Figure 3:
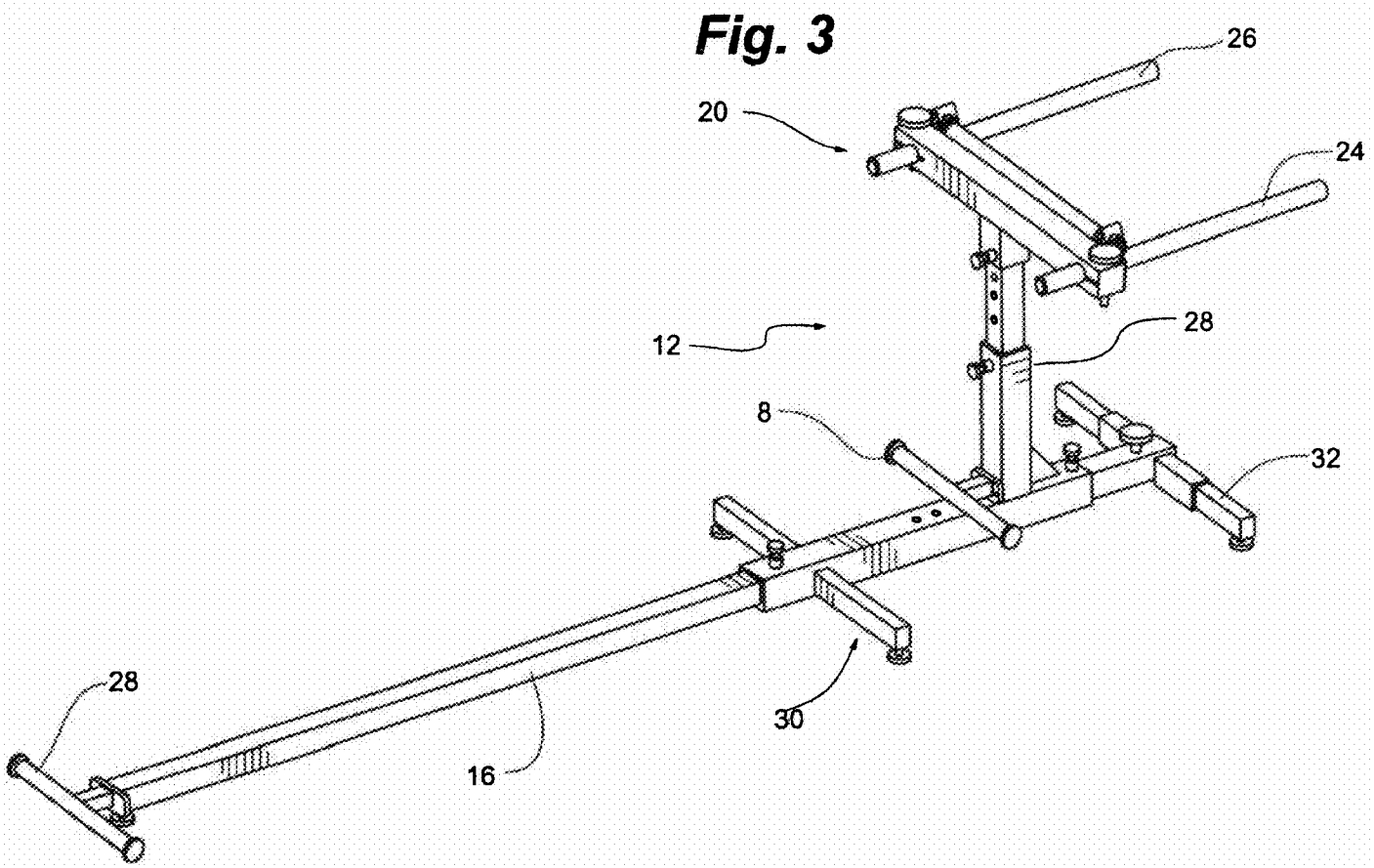
FIG. 3 illustrates an angled top-down perspective view of front support member of an exercise apparatus according to a first embodiment.

FIG. 3 illustrates generally front support assembly 12 shown separate from exercise support apparatus 14 according to one embodiment. Front support assembly 12 may be utilized for performing leg exercises as will be described in greater detail below. In the embodiment shown in FIG. 3, back stability member 32 is formed separate from base 22.

Although not illustrated in FIGS. 1-6, handrail assembly 20 may include elbow pads or other gripping means integrated into handrail assembly 20. Handrails 24 and 26 may include vertical gripping members instead of or in addition to the horizontal gripping members depicted. The vertical hand grips and the elbow pads may in combination resemble commercially available "aerobars."

FIG. 1 also illustrates exercise support surface 14 and base 22 coupled to front support assembly 12. Exercise support surface 14 is constructed to receive an exercise ball, for example a commercially available inflatable rubber or plastic ball commonly used for core strengthening exercises, at an upward facing surface to enable a user perform various exercises. Exercise support surface 14 may be permanently, semi-permanently, or releaseably secured to base 22.

Figure 2:
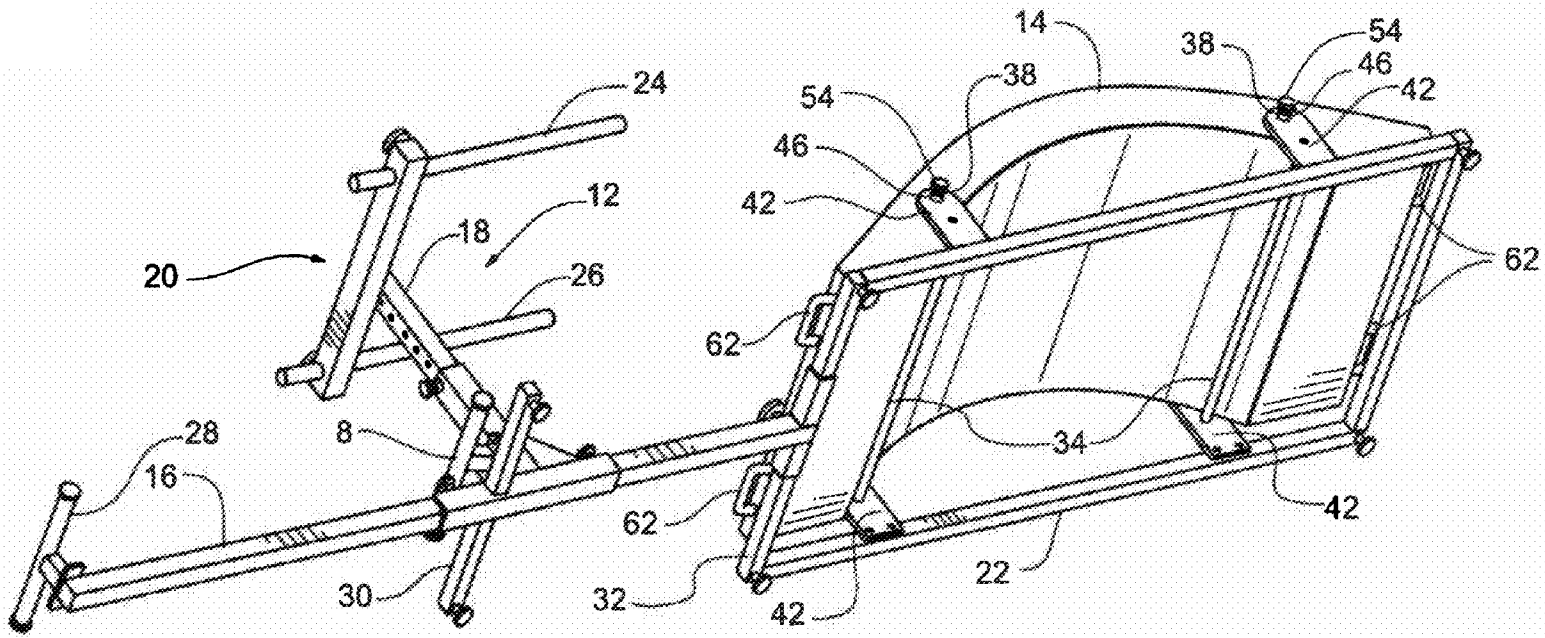
FIG. 2 illustrates an angled bottom-up perspective view of an exercise apparatus according to a first embodiment.
Figure 5:
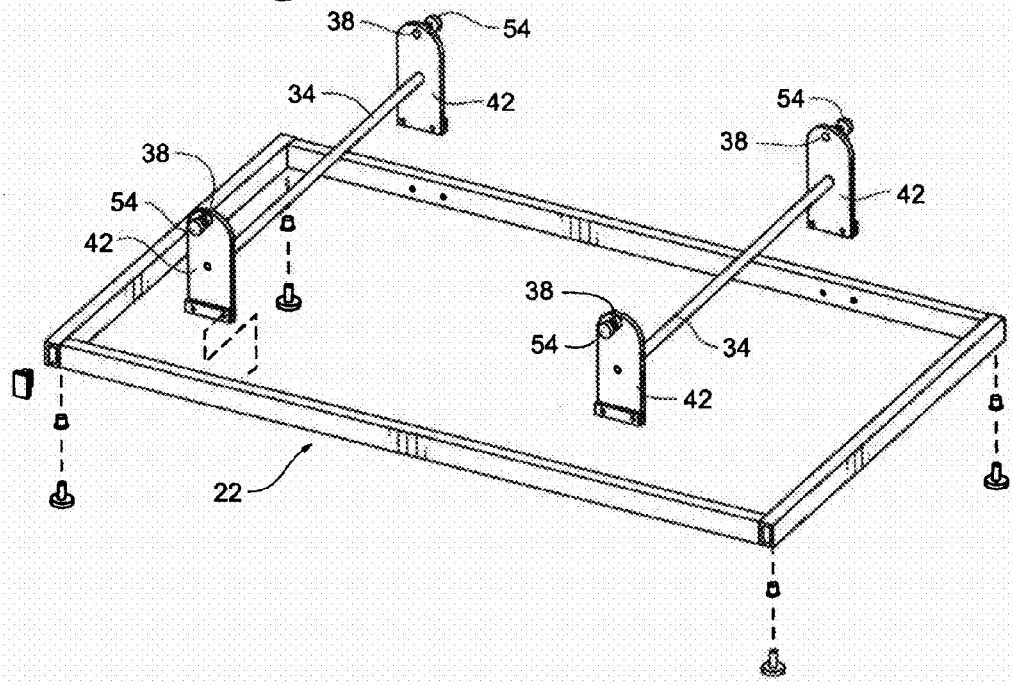
FIG. 5 illustrates a top-down perspective view of a base of an exercise apparatus according to a first embodiment.

As shown in FIG. 1, and as shown in further detail in FIG. 5, exercise apparatus 10 includes vertical support members 42 on opposed sides of base 22. Crossbars 34 are shown with respective ends disposed in apertures in vertical support members 42. As shown in FIGS. 1 and 2, exercise support surface 14 may be arranged upon crossbars 34 to permanently, semi-permanently, or removeably secure exercise support surface to base 22. Exercise support surface 14 may instead include one or more apertures adapted to receive crossbars 34 to secure exercise support surface 14 to base 22.

In both concave and convex configuration, exercise support surface 14 may be adapted to rest upon or receive crossbars 34, 36 to support exercise apparatus 14. Vertical support members 42 may include affixation mechanisms 38, 54 to be used in conjunction with affixation members 46 to anchor exercise surface 14 to vertical support members 42. Affixation mechanism 38, 46, and 54 may be bolts and/or associated apertures. Affixation members 38, 46, and 54 may instead be pairs of spring-loaded plungers, magnets, or pop-pin locks.

In FIG. 1, exercise support surface 14 is shown in a concave configuration. FIG. 3 shows exercise support surface 14 in a convex configuration. In configurations not depicted, exercise support surface 14 may be substantially flat or substantially arcuate. Exercise support surface 14 may be switchable between concave, convex, arcuate and/or flat configurations by changing an orientation with respect to base 22.

Although not depicted in FIGS. 1-5, exercise support surface 14 may be constructed to have different angles of inclination with respect to base 22 depending on an orientation with respect to front support assembly 12. For example, a first end of exercise support surface 14 disposed adjacent to front support assembly 12 may present a greater angle of inclination than a second end disposed adjacent to front support assembly 12.

Also not depicted in FIGS. 1-5, exercise surface 14 may further be constructed to tilt in a forward or backward direction relative to support unit 22. Exercise apparatus 10 may include mechanisms (not depicted) to allow a user to adjust a tilt of exercise surface 14 and lock exercise surface 14 in particular tilt position. Exercise support unit 14 may further include handles 62. Handles 62 may be utilized to adjust a tilt of exercise surface 14, or may also be utilized to enable a user to move, adjust, or re-orient exercise support surface 14.

FIGS. 1-5 illustrate that base 22 may be secured to front support assembly 12. As shown in FIG. 1, back stability member 32 is formed integral to base 22. An end of main stability bar 16 includes an affixation member adapted to interface with base 22/back stability member 32. Back stability member 32 may instead be presented independent from base 22 and is adapted to be secured to base 22.

As depicted in FIG. 1, base 22 may be coupled to main stability bar 16 via a knob coupled to a bolt or other affixation mechanism. Although not depicted in FIGS. 1-5, base 22 may be adapted to be coupled to front support assembly 12 in a variety of configurations. For example, base 22 may be coupled to front support assembly 12 via any of the four sides of base 22 to allow a user to perform a greater variety of exercises.

FIGS. 6-20 illustrate generally various perspective views of another embodiment of an exercise apparatus according to various aspects of the invention described herein. Exercise apparatus 110 includes front portion 111 and back portion 113. Back portion 113 is constructed to allow a user to place an exercise ball upon, and front portion 111 is constructed to provide a user with a stable handgrip for gripping while the user is situated upon the exercise ball in various positions.

As illustrated, front portion 111 includes ground support unit 116. Ground support unit 116 may be adapted to be situated upon a floor or other surface to provide stability. Ground support unit 116 may be situated directly in contact with a floor or other surface, or ground support unit 116 may include one or more floor contact members such as one or more wheels 137 or castors so ground support unit 116 may be easily moved by a user. Wheels 137 may include one or more locking mechanisms to secure a position of ground support unit 116 on a floor or other surface.

As shown in FIGS. 6-20 ground support unit 116 includes main stability bar 146. Front stability bar 130 and back stability bar 132 are positioned along main bar 146. Front stability bar 130 and back stability bar 132 are sized, shaped, and arranged to provide support to ground support unit 116 in a direction perpendicular to main bar 146. Back stability bar 132 may be adapted to interface with back portion 113 as will be described in greater detail below.

Front portion 111 further includes vertical unit 118 and hand support assembly 120. Vertical unit 118 is adapted to support hand support assembly 120 to provide a user a stable handle for gripping while performing exercises.

Figure 6:
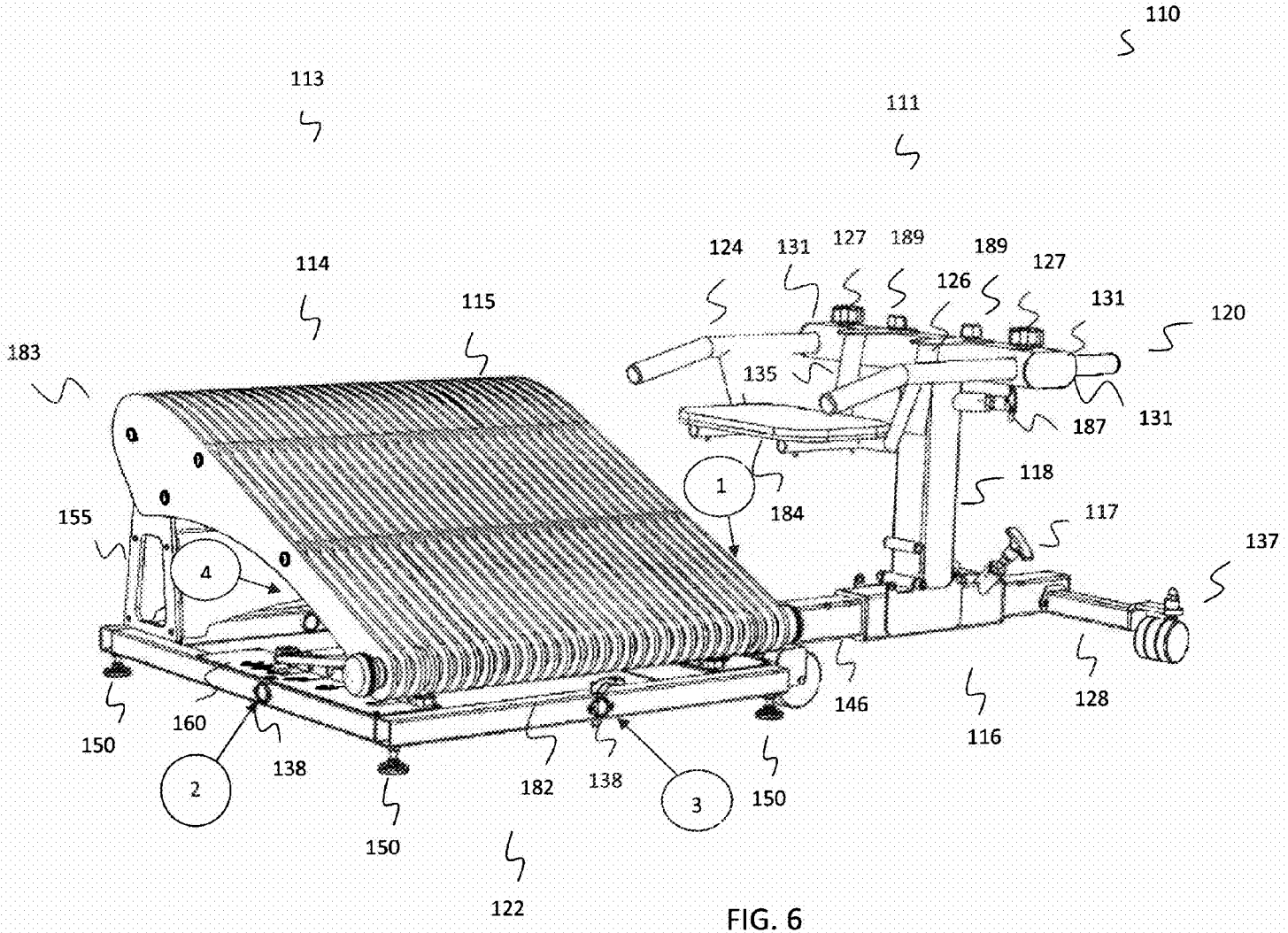
FIG. 6 illustrates an angled side perspective view of an exercise apparatus according to a second embodiment.
Figure 7:
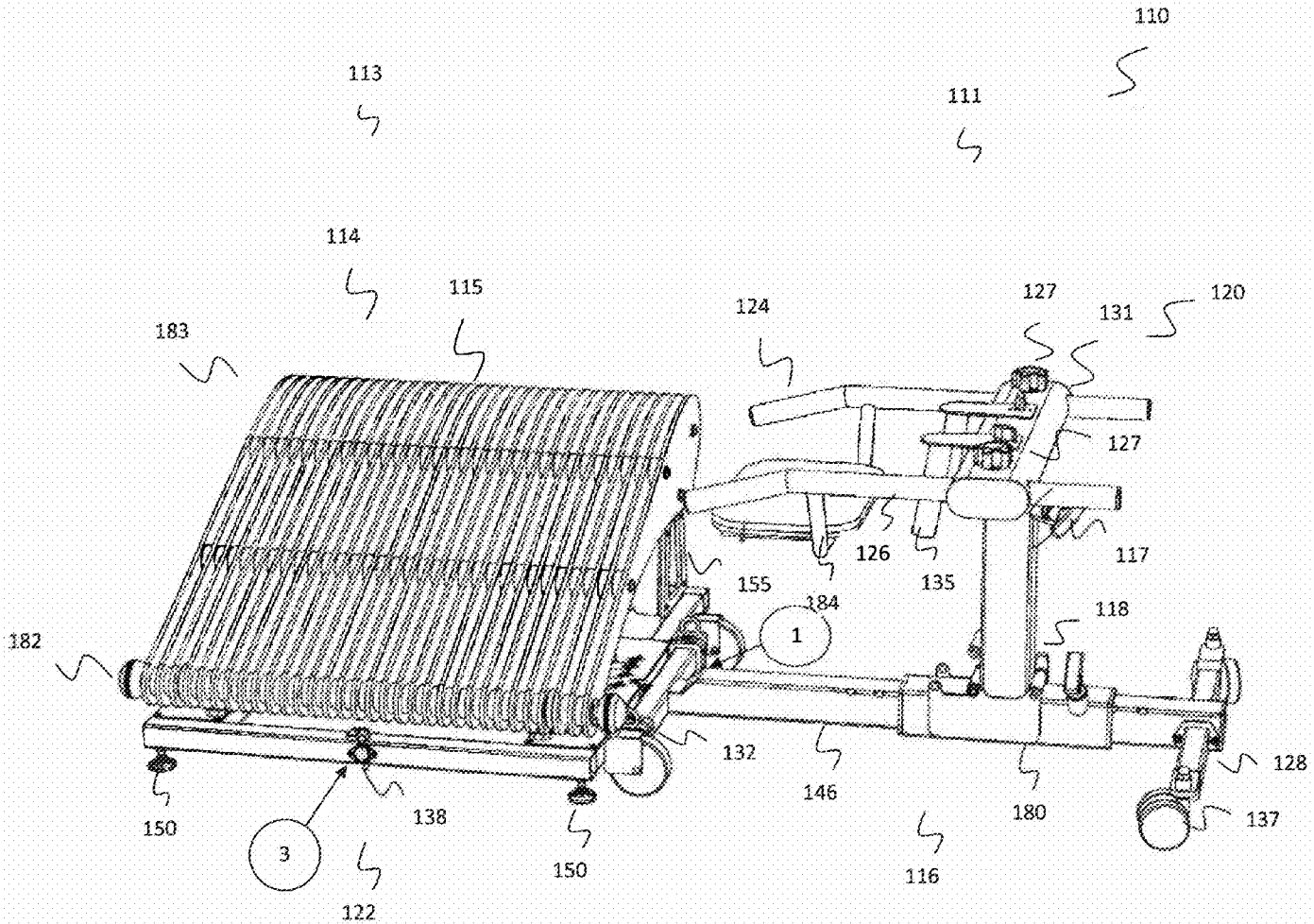
FIG. 7 illustrates a side perspective view of an exercise apparatus according to a second embodiment.

Vertical unit 118 is constructed to be secured to ground support unit 116 in a stable manner. Vertical unit 118 may be permanently, semi-permanently, or adjustably secured to ground support unit 116. As depicted in FIGS. 6-7, a bottom end of vertical unit 118 may include handle glider 180 adapted to allow a user to adjust a position of hand support assembly 120 to be closer to or further away from back portion 113 when back portion 113 is secured to front portion 111. A bottom end of vertical support unit may also include one or more locking mechanisms 117 adapted to allow a user to secure vertical support unit 118 at a position with respect to ground support unit 116. Locking mechanism 117 may be one or more pop pin locks or one or more bolts or screws.

Vertical unit 118 may further include one or more height adjustment mechanisms such that a height of vertical unit 118 is adjustable to fit a particular user's physical dimensions and/or to enable a user to perform different exercises. For example, vertical unit 118 may be formed of a first portion that includes an interior cavity with an opening at a top end. The opening, and the cavity, may be constructed to receive a second portion secured to hand support assembly 120. One or more locking mechanisms, such as pop pin lock 187 illustrated in FIG. 6, may enable securing of a height of hand support assembly 120 with respect to ground support unit 116. Vertical unit 118 may instead or in addition include one or more telescoping portions for height adjustment.

Hand support assembly 120 arranged at a top end of vertical unit 118 is constructed to provide a user a grip while performing exercises according to various aspects of the invention described herein. Hand support assembly 120 may be constructed to be similar to known bicycle handlebars. In the embodiment depicted in FIGS. 6-26, hand support member includes two gripping portions, horizontal gripping members 124 and 126, and vertical gripping members 135. Horizontal gripping members 124 and 126 are constructed to be similar to the handlebars of many known bicycles. Vertical gripping members 135 are constructed such that a user may place his elbows and/or forearms upon elbow support member 184 and grip vertical gripping members 135. Vertical gripping members 135 and elbow support member 128 in combination may present a grip similar to known "aerobars." One of skill in the art will recognize that the instant invention is not limited to the hand grips explicitly shown and described herein. Instead, any mechanism suitable for gripping during exercise is within the spirit and scope of the invention described herein.

Figure 10:
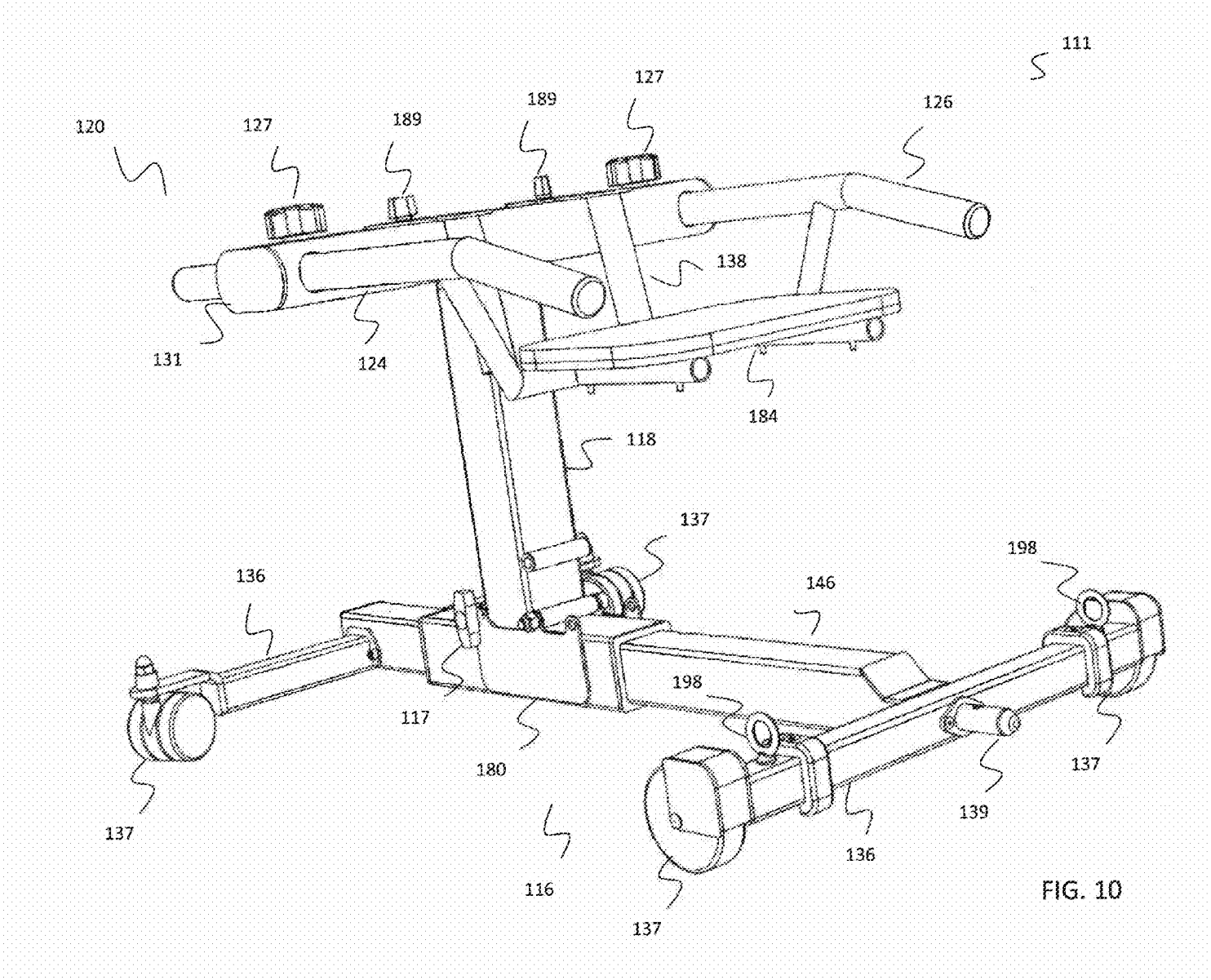
FIG. 10 illustrates a back perspective view of a front portion of an exercise apparatus according to a second embodiment.
Figure 11:
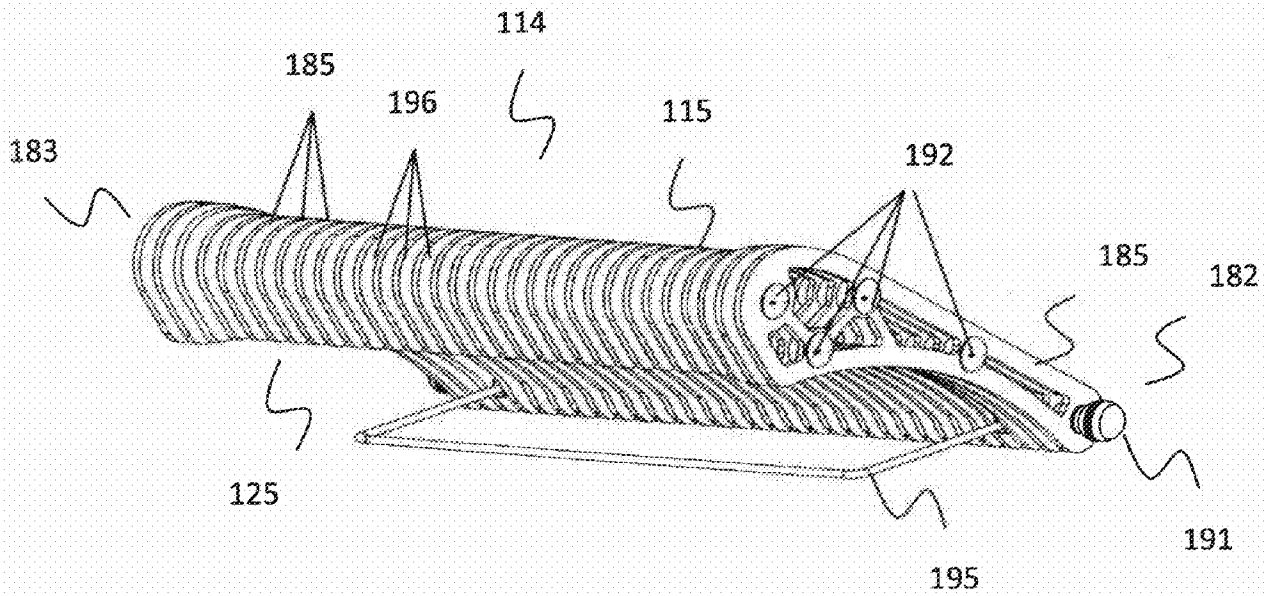
FIG. 11 illustrates a perspective view of an exercise support member of an exercise apparatus according to a second embodiment.
Figure 12:
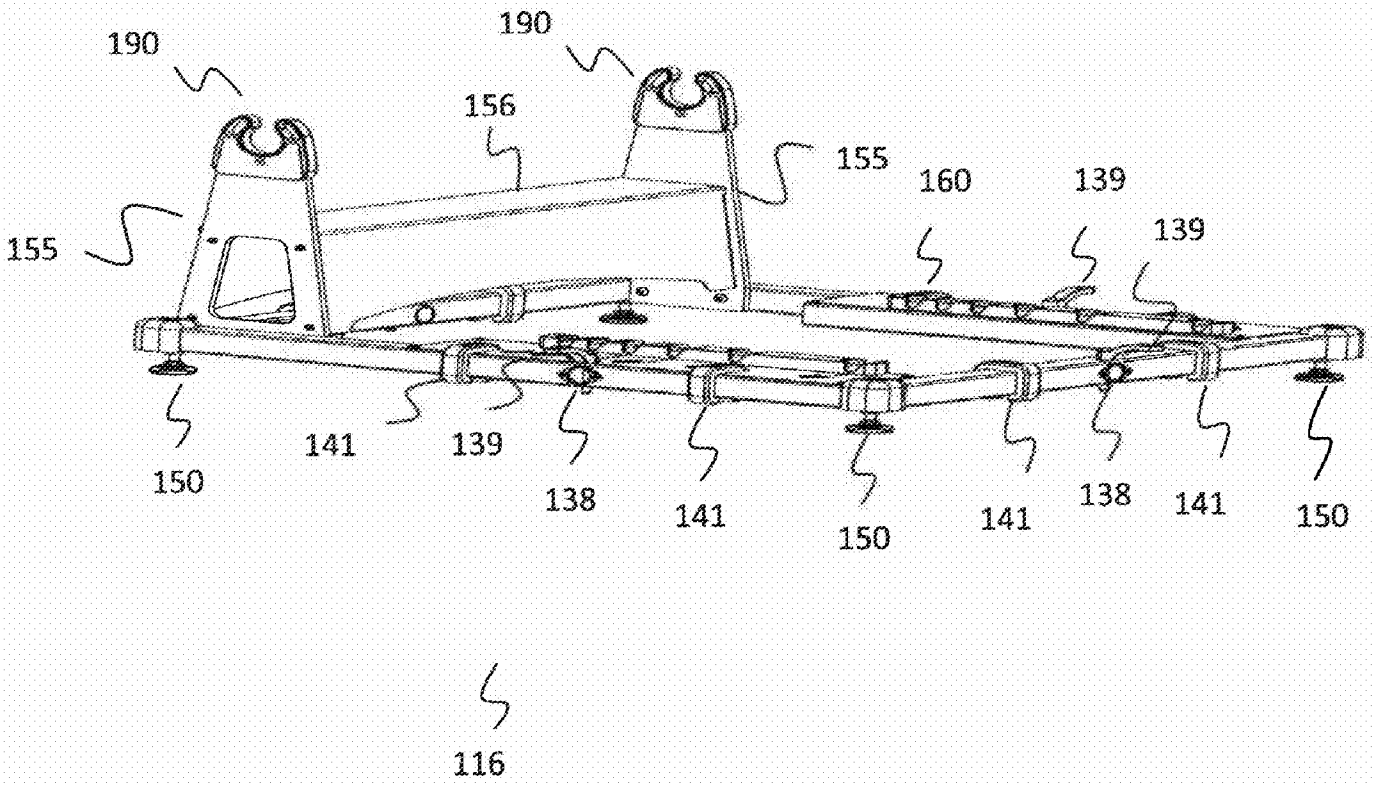
FIG. 12 illustrates a side perspective view of a base of an exercise apparatus according to a second embodiment.
Figure 13:
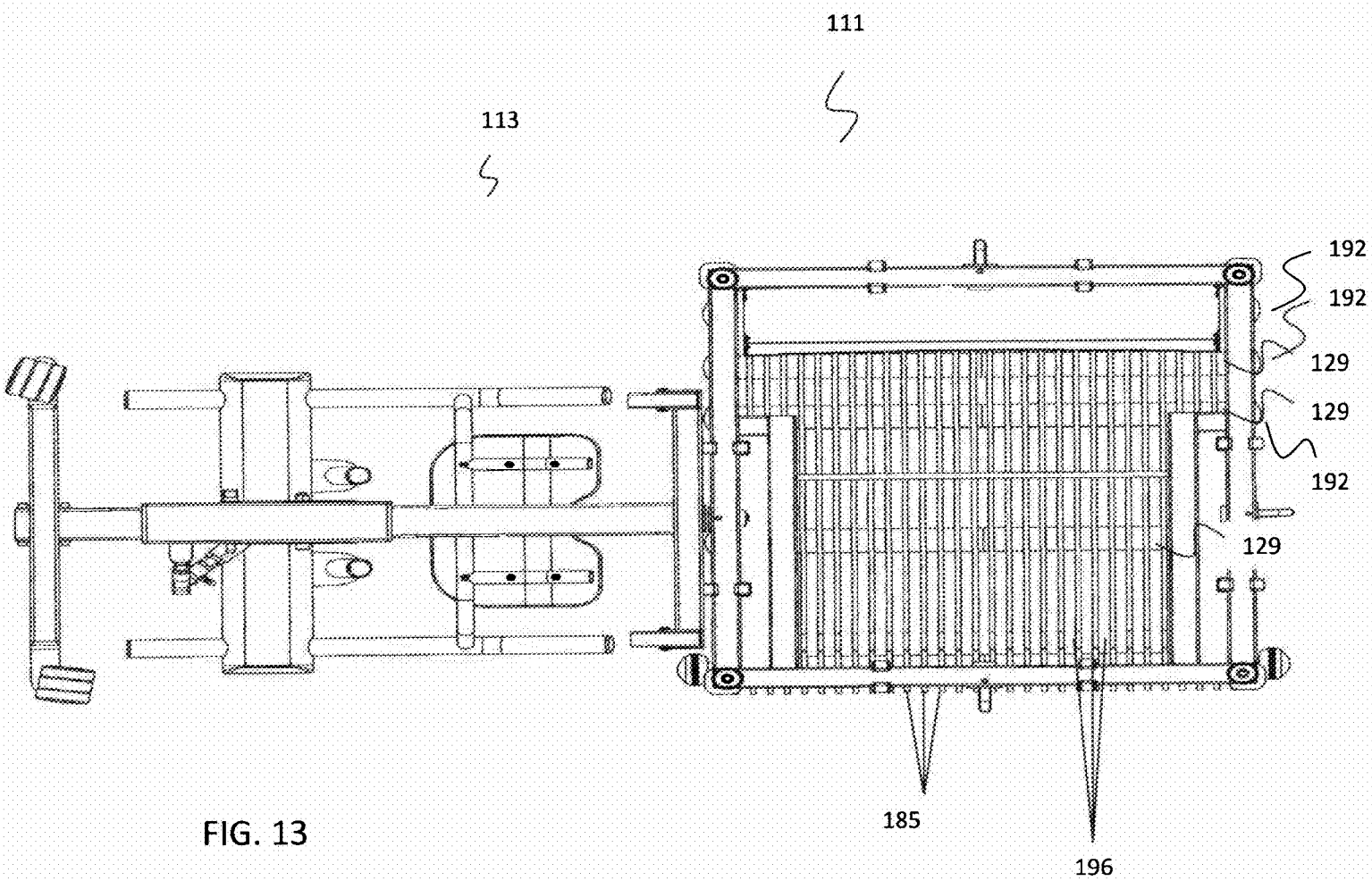
FIG. 13 illustrates a bottom-up perspective view of an exercise apparatus according to a second embodiment.

Hand support assembly 120 may be constructed to be adjustable to fit a particular user's physical dimensions, or to enable a user to perform different exercises or exercises of varying intensity. Referring to FIG. 10, an elongated portion of horizontal gripping members 124, 126 may be constructed to fit in one or more apertures of cross tube 131 situated at a top end of vertical support member 118. Horizontal gripping members 124 and 126 may be adjustable such that they may be moved in a forward or backward direction relative to back portion 113. Horizontal gripping members 124, 126 may instead be fixed.

Vertical gripping members 135 and elbow support member 184 may also be adjustable. In the embodiments shown in FIGS. 6-26, vertical gripping members 135 are releasably secured to cross tube 131 to allow a user to adjust a forward/backward position of vertical gripping members 135 and elbow support member 184. Hand support assembly 120 may include knobs 127 and 189 allow a user to secure a position of horizontal gripping members 124 and 126, vertical gripping members 135, and/or elbow support member 184 by tightening a bolt through an aperture in cross tube 131.

Figure 19:
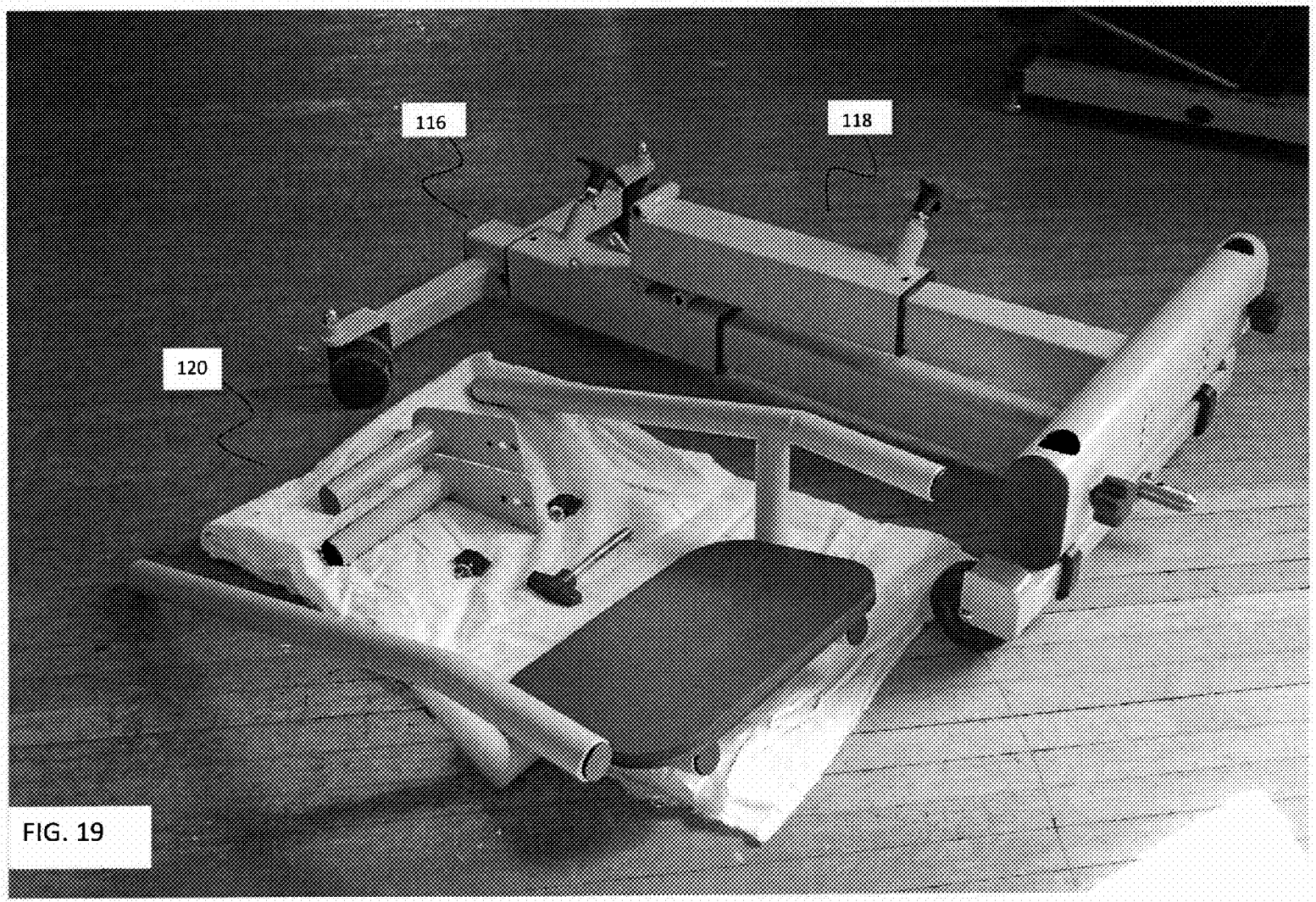
FIG. 19 illustrates a top-down perspective view of a front portion of an exercise apparatus separated into individual parts according to a second embodiment.

Horizontal gripping members 124, 126, vertical gripping members 135, and elbow support member 184 may be interconnected, or may be independently presented on hand support assembly 120. As shown in FIG. 19, hand support assembly 120 may be composed of separable parts. Components of hand support assembly 120 may be constructed such that a user may configure hand support assembly 120 to present horizontal gripping members 124-126, vertical gripping members 135 and/or elbow support member 128 independently.

Figure 8:
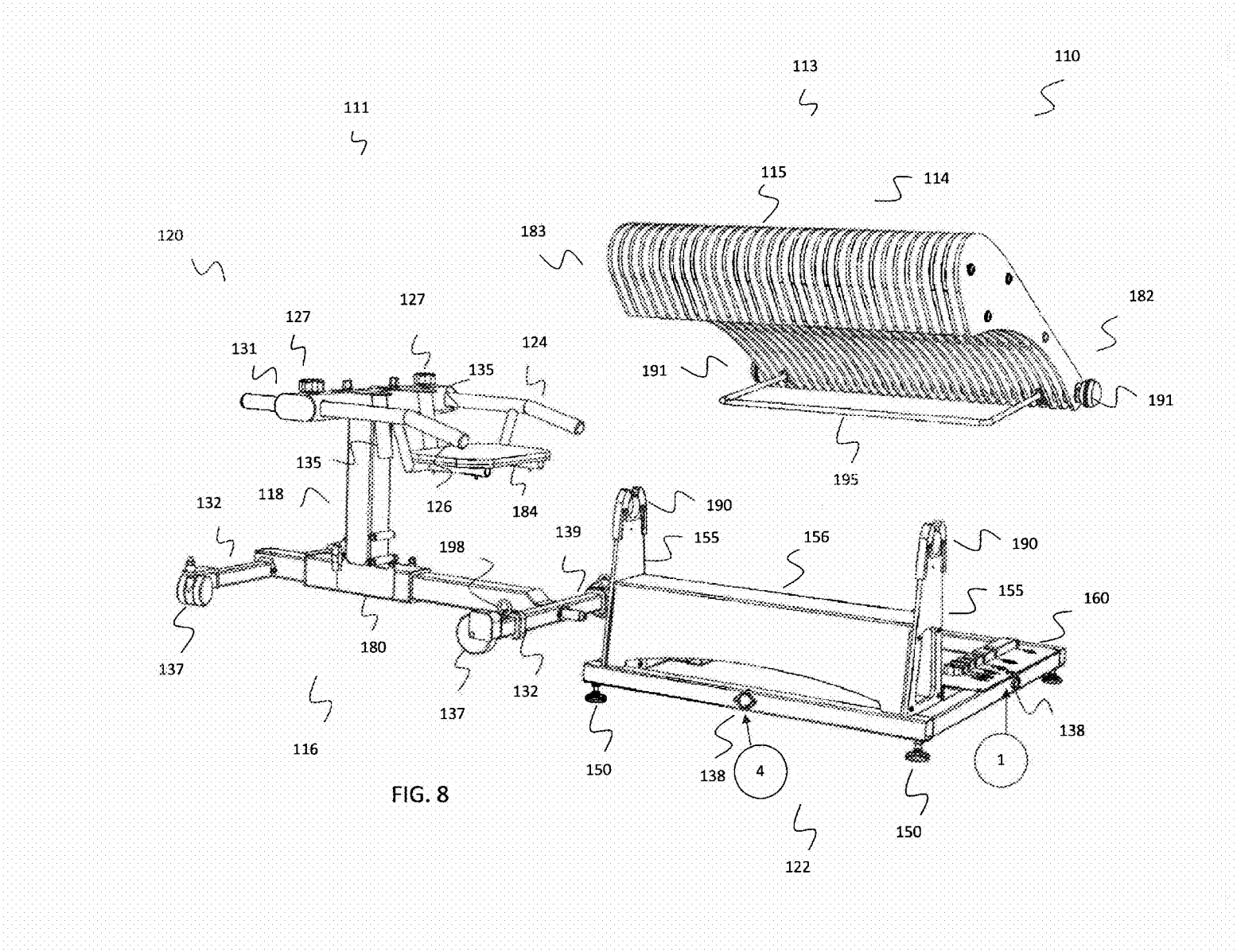
FIG. 8 illustrates an angled side perspective view of an exercise apparatus with front portion, base and exercise support member separated from one another according to a second embodiment.
Figure 9:
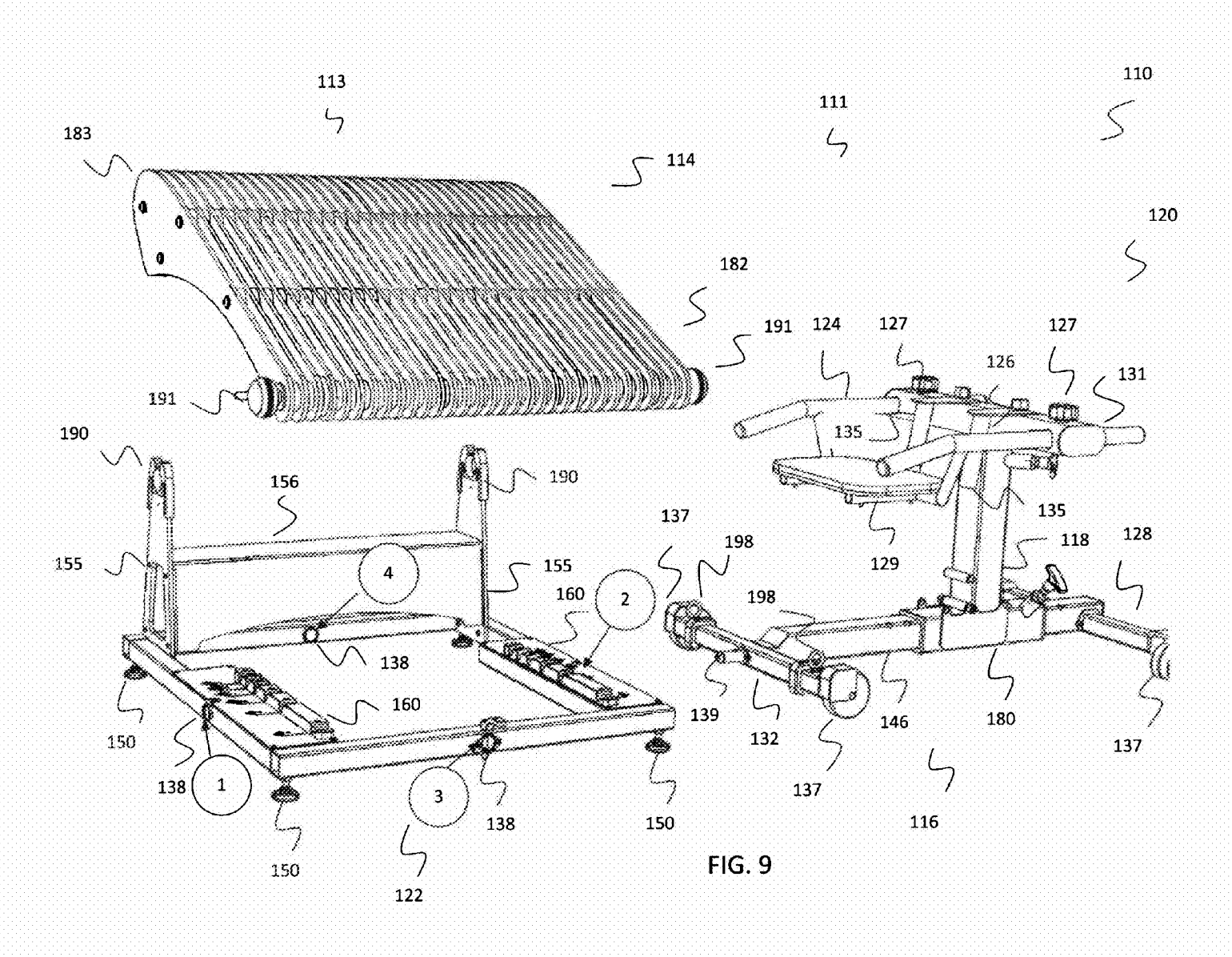
FIG. 9 illustrates an angled side perspective view of an exercise apparatus with front portion, base and exercise support member separated from one another according to a second embodiment.

As also depicted, front portion 111 may further include one or more eyelets 198. Eyelets 198 may be adapted to receive an exercise band or other exercise device to allow a user to perform various exercises as will be described below. As shown in FIG. 8, eyelets 198 may be positioned on back support member 132.

Back portion 113 of exercise apparatus 110 is constructed to present a stable and adjustable support surface for a user to position an exercise ball upon to perform exercises as discussed in greater detail below. As shown in FIGS. 6-9, back portion 113 includes base 122, vertical support 155, and exercise support member 114. Base 122 may be adapted to rest directly upon a floor or other surface. Base 122 may also include one or more support mechanisms 150. Support mechanisms 150 may be adjustable to set a height of base 122 from a floor or other surface.

Exercise support member 114 is constructed to enable a user to balance an exercise ball upon without causing the exercise ball 199 to slip from surface 115. Exercise support member 114 may include a series of similarly shaped "plates" 185 coupled together to form at least one surface 115. Plates 185 may be constructed of plexiglass, however any material construction of plates 185 is contemplated.

Plates 185 may be secured to one another by one or more rods 129 inserted through one or more apertures in plates 185. A position of plates 185 relative to one another may be secured by one or more spacers 196 inserted between adjacent plates 185. Rods 129 may be secured in place via one or more screw caps 192.

Exercise support member 114 may include a first surface 115 and a second surface 125. First surface 115 may be a substantially flat surface, while at least one portion of second surface 125 may be substantially arcuate. First and second surfaces 115, 125 may be any combination, in whole or in part, of flat, angled, annular, or other surfaces.

Exercise support member 114 may further include adjustable leg 195 positioned at a first end 182 of exercise support member 114. Adjustable leg 195 may be secured to exercise support member 114 via a rod (not shown) through plates 185. Exercise support member 114 may include protruding screw caps 191, which enable a user to secure an angle of adjustable leg 195 with respect to surface 115 or 125. Adjustable leg 195 may be reversible to an acute angle position with respect to either surface 115 or surface 125 of exercise support member 114.

Figure 14:
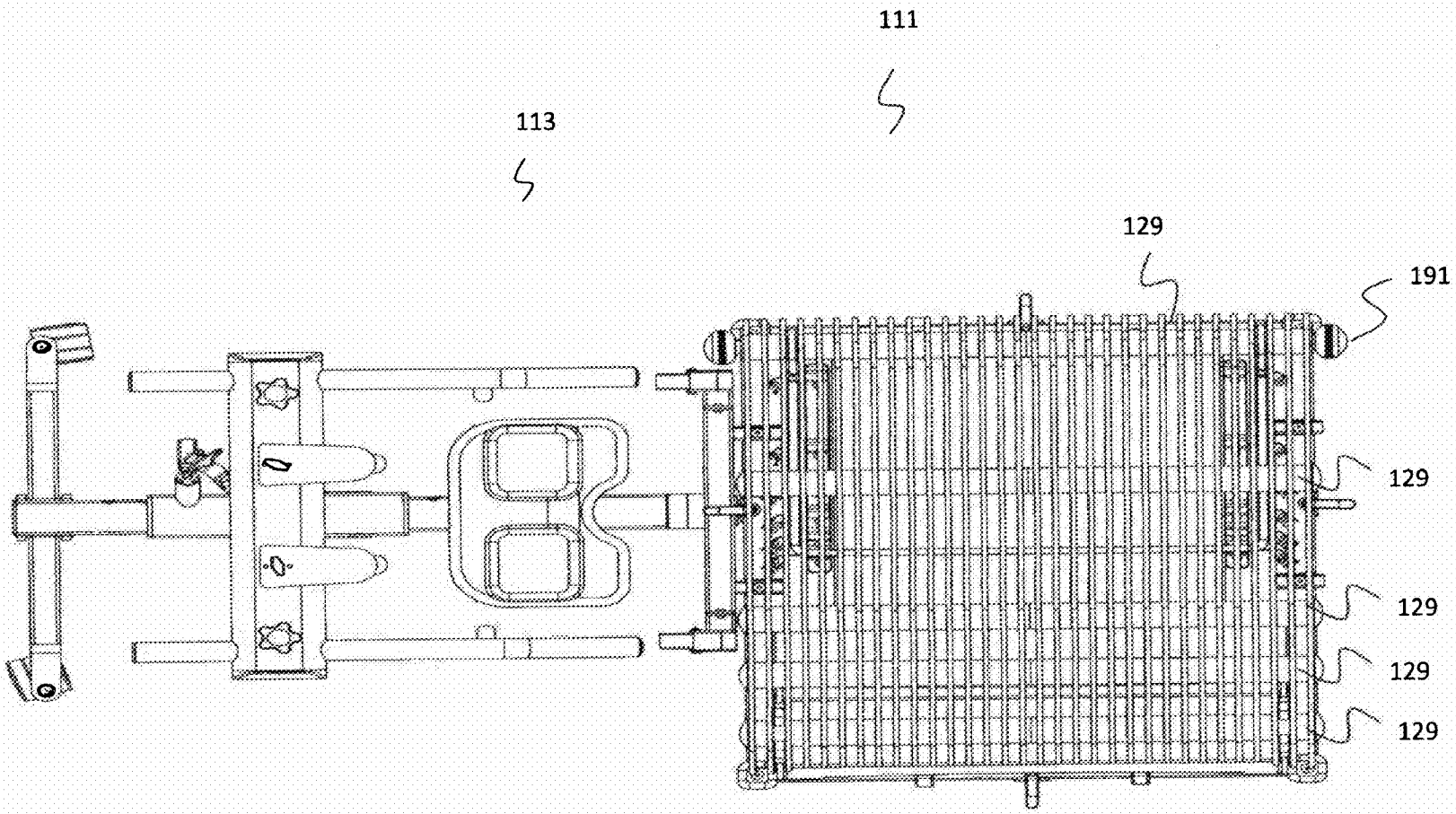
FIG. 14 illustrates a top-down perspective view of an exercise apparatus according to a second embodiment.

As shown in FIG. 14, base 122 includes main pivot uprights 155. Main pivot uprights 155 are coupled to base 122, and upright brace 156 is positioned between main pivot uprights 155 to provide additional stability to main pivot uprights 155. As also shown, main pivot uprights may include main pivot yokes 190. Main pivot yokes 190 are adapted to receive second end 183 of exercise support member 114. Main pivot yokes 190 may be adapted to receive at least one bar 129 traversing second end 183. Main pivot yokes 190 may be sized and shaped to be inserted in a space between plates 185 to interface with at least one bar 129.

Figure 16:
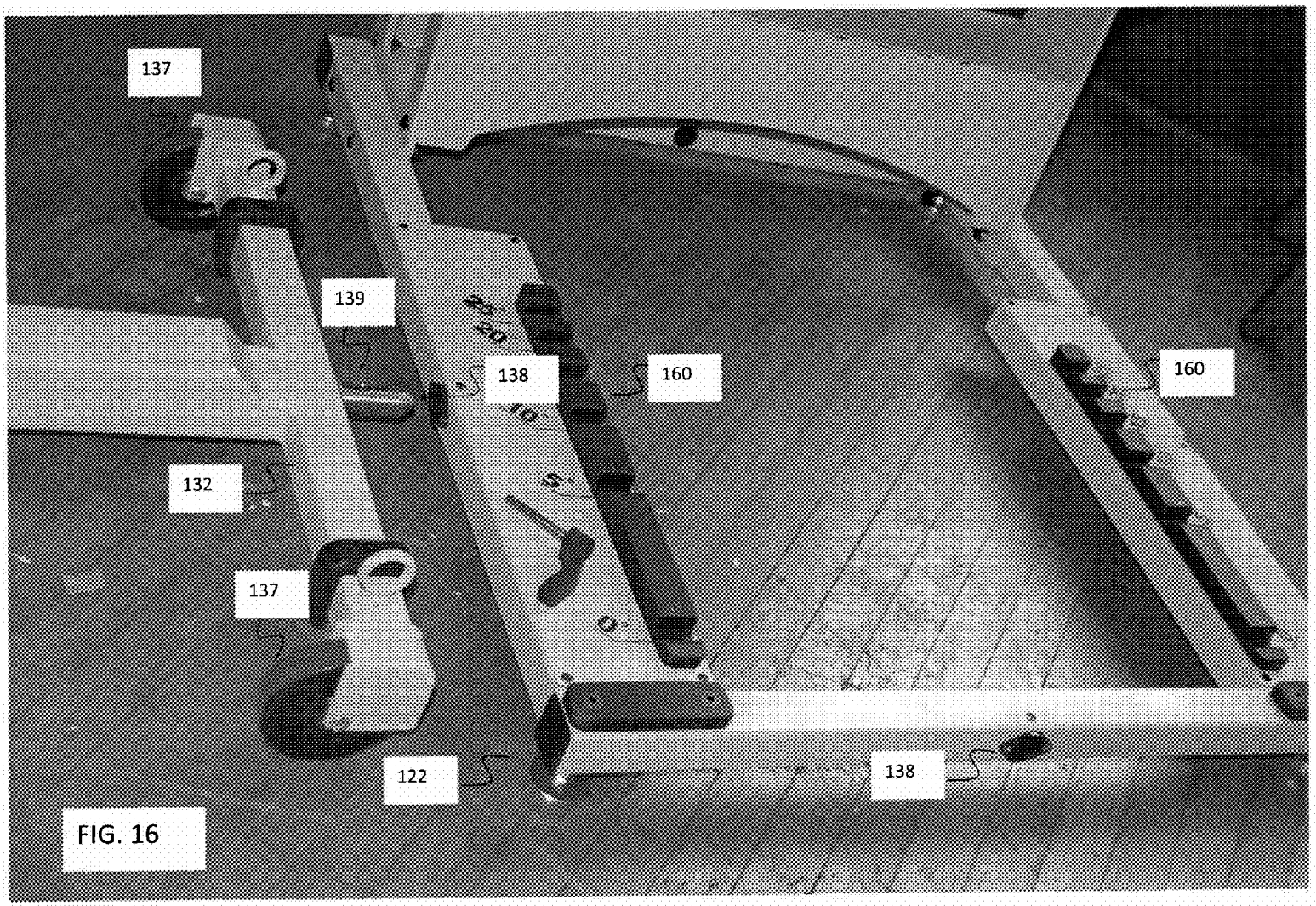
FIG. 16 illustrates a top-down perspective view of a base of an exercise apparatus including an angle plate at a top surface of the base according to a second embodiment.

As also shown in FIG. 16, base 122 may include angle plate 160. Angle plate 160 is adapted to present, at a top surface of base 122, a series of divots each constructed to receive adjustable leg 195. Angle plate 160 may include markings presenting to a user various angles of inclination that may be selected by the user.

Base 122 also includes at least one mating portion 138 constructed to interface with an associated mating portion of front end 111. Base 122 includes an aperture 138, while back support member 132 of ground support member 116 includes a protruding portion 139 adapted to mate with aperture 138. Protruding portion 139 may be inserted into aperture 138 and secured, for example by a pin 140 or by other means.

Back portion 113 may be constructed to be arranged in a variety of different positions with respect to front end 111 to allow a user to perform a variety of different exercises with an inclination in a different direction. For this purpose, base 122 may include a plurality of mating portions 138 positioned on each side of base 122. By coupling back portion 113 to front portion 111 via mating portions 138 on different sides of base 122, a user may arrange exercise support member 114 so that an angle of inclination of exercise support member 114 is sloping from front to back (position 4), from back to front (position 3), from left to right (position 1), or from right to left (position 2) with respect to front end 111.

Base 122 may further include bumpers 141. Bumpers 141 may be formed of rubber, plastic, or similar materials to provide an interface for front end 111 to abut base 122 when front end 111 is coupled to back end 113. Bumpers 141 may protect interfacing portions of front end 111 and back end 113 and/or may provide additional stability to an interface between front end 111 and back end 113.

Exercise apparatus 110 described herein is adapted to provide a user with a unique exercise experience. While front portion 111 provides, via hand grip assembly 120, a user with a bicycle style grip for enhanced training experience transferrable to cycling, back portion 113 provides the user with a unique and customizable platform for performing a variety of physiologically beneficial movements, at least some of which are discussed in greater detail below.

Exercises

The exercise program and apparatus described herein advantageously provide for specific training of a users core musculature, specifically the trunk and the pelvis. By using exercise apparatus 10, 110, a user will be able to develop preferred movement patterns of the core musculature that can then be applied to a desired sport, such as cycling. This isolated and focused exercise not only provides a user with an ability to increase core musculature strength and flexibility, a user may also be able to improve his or her kinetic awareness, which may translate to the user's cycling performance.

To perform the various exercises discussed below, a user may select one of opposing surfaces 115 and 125 of exercise support member 114 to be positioned facing upwards depending on whether the user desires a substantially arcuate or substantially flat surface for exercising upon. Exercise support member may further provide for the selectability of convex or concave surfaces. If a user is in possession of an additional exercise support member 114, a user may have more than two surfaces to choose from.

The user may select one of positions 1-4 as depicted in FIG. 1 for example, in order to select an orientation of the angle of inclination of exercise support member 114 with respect to front portion 111. In addition, depending on both the level of skill and a particular exercise a user seeks to perform, a user may select an angle of inclination of exercise support member 114 with respect to base 122 using angle plate 160 and adjustable leg 195. For example, a more novice user may select an inclination angle of 5 degrees, while a more experienced user may select an inclination angle of 20 or more degrees. To vary an intensity of any exercise discussed herein, a user may further adjust a height of vertical support 118, or a positioning of hand grips 124, 126, 135, and/or elbow support member 184. A user may also utilize horizontal hand grips 124, 126, or vertical hand grips 135 in combination with elbow support member 184.

Various examples of exercises that may be performed by a user using exercise apparatus 10 or 110 are described in the proceeding sections. One of skill in the relevant art will understand that any exercise using apparatus 10 or 110 is within the spirit and scope of the invention described herein.

Trunk Pelvic Roll

Figure 15:
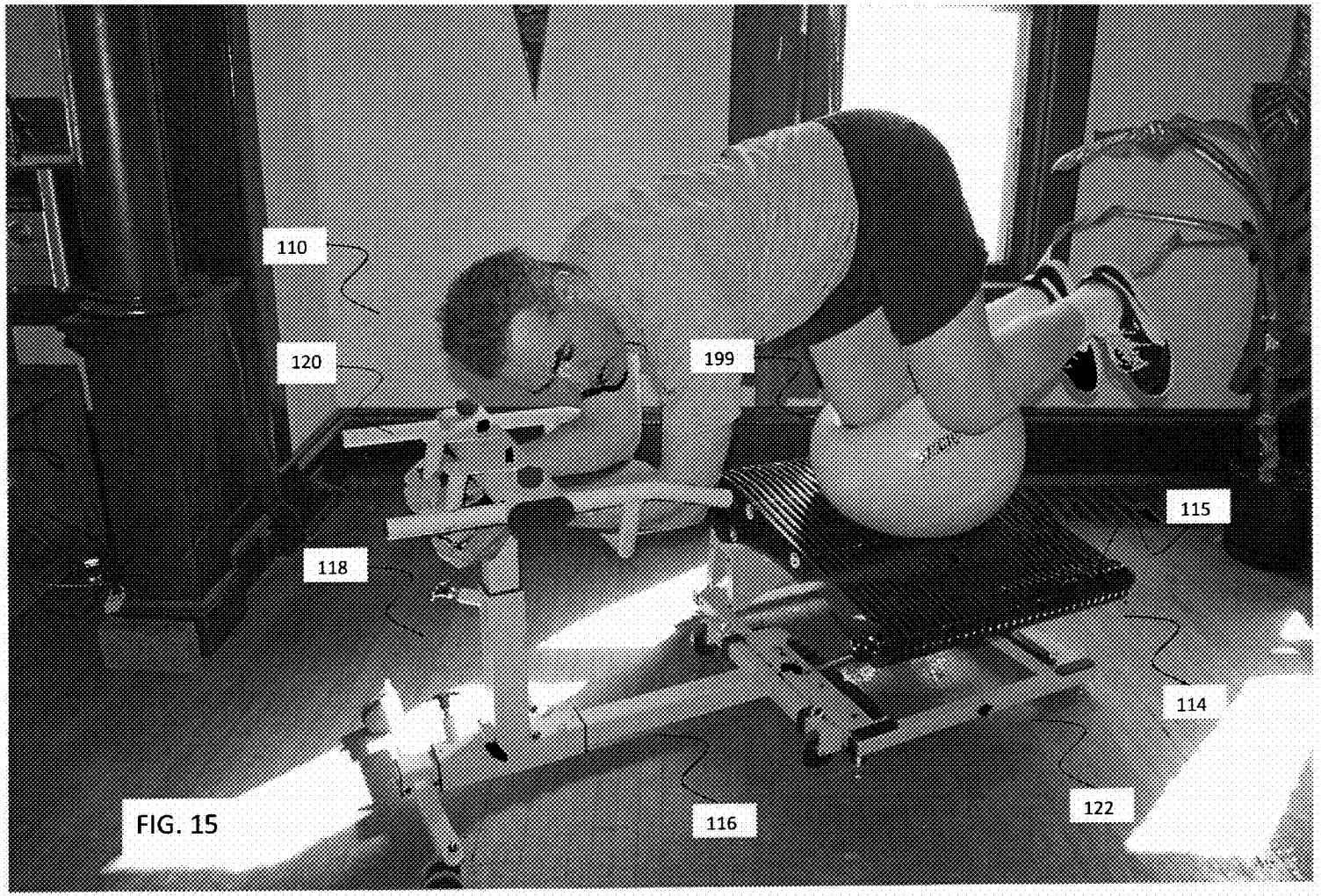
FIG. 15 illustrates an angled top-down perspective view of an exercise apparatus used to perform a trunk pelvic roll exercise according to a second embodiment.

In an embodiment, exercise apparatus 110 enables a user to perform a trunk pelvic roll exercise as illustrated in FIG. 15. To do so, a user may position exercise support member 114 so that substantially flat surface 115 is facing upwards.

A user may couple front portion 111 to back portion 113 in position 1 or 2 as shown in the drawings, so that an angle of inclination of exercise support member 114 is from side to side relative to front portion 111. For example, to perform the trunk pelvic roll to exercise a user's right side, the user may place exercise support surface in position 1. To exercise a user's left side, the user may place exercise support member 114 in position 2.

To perform the exercise, a user may place exercise ball 199 on flat surface 115 at position near second end 183, or at the highest end of exercise support surface member 114 and grip hand support assembly 120. The user may situate one leg on the exercise ball and maintain his hips and knees in a flexed orientation. The user may then roll the ball down the slope of exercise support surface 115 and back (in a left and right direction), while maintaining an orientation of the user's core musculature, such as the user's shoulders, back, and abdominal musculature, in a stable state.

The scapulothoracic joint will initiate the roll of the upper trunk on the shoulder blades. The thoracic trunk will roll in unison with the user's abdominal area and pelvis. In performing the exercise, the user's abdominal obliques will enable his/her pelvis to roll in unison with the user's thoracic trunk. Instead, the user may only move his/her pelvis.

Static Trunk Pelvic Exercise

A user may also perform a trunk pelvic exercise while maintaining exercise ball 199 in a static position. To do so, the user may couple front portion 111 to back portion in position 3 such that first end 182 is positioned adjacent to front portion 111. The user may also orient exercise support member 114 so that flat exercise support surface 115 is facing upwards.

To perform the static trunk pelvic exercise, a user places one leg and knee upon exercise ball 199, grips hand support assembly 120, and maintains ball 199 in a static position while moving back and forth in a direction perpendicular to the angle of inclination of exercise support member 114. The static trunk pelvic exercise provides similar advantages to the trunk pelvic roll described above.

Although the above description of the trunk pelvic roll and the static pelvic exercise are described with substantially flat surface 115 of exercise support member 114 facing upwards, they may also be performed using substantially arcuate surface 125 facing upwards.

Sidebend-Pelvic Movement and Hip Hike

Figure 17:
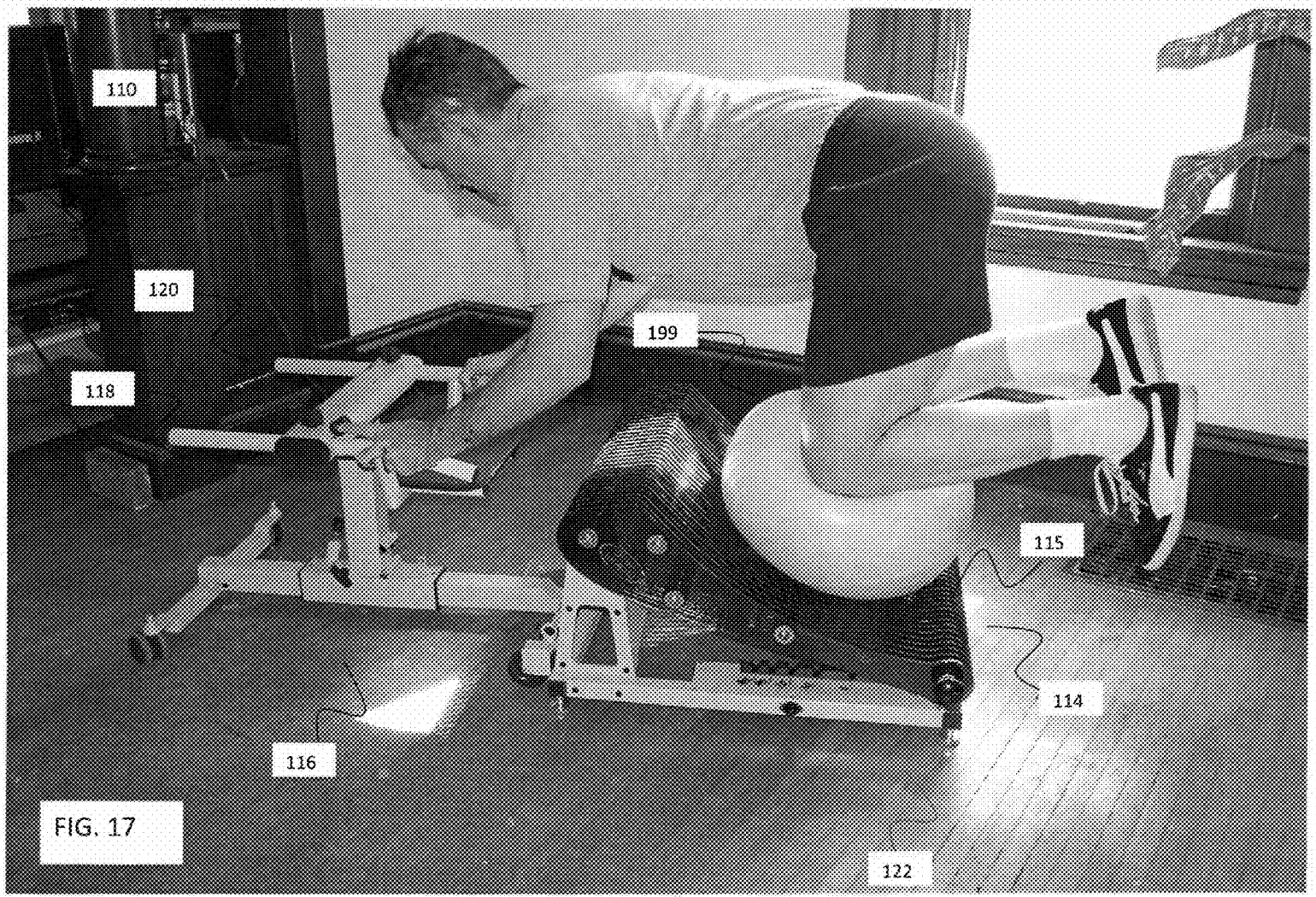
FIG. 17 illustrates a side perspective view of an exercise apparatus used to perform a sidebend and/or hip hike exercise according to a second embodiment.

Another exercise enabled by exercise apparatus 10, 110 is a sidebend-pelvic movement and hip hike as illustrated in FIG. 17. To perform this exercise, a user arranges back portion 113 in position 4, such that second end 183 of exercise support member 114 is adjacent to front portion 111. Exercise support member 114 may be arranged such that substantially arcuate surface 125 is facing upwards.

A user may place both knees and legs in a straddling position with respect to exercise ball 199. The user then rolls ball 199 left and right (sidebending), while again maintaining the user's core musculature, such as the abdominal obliques, in a substantially contracted and stable position. If a user is sidebending to the left, this motion will create separation of the right rib cage from the right pelvis, thus triggering a quick stretch response at the right quadratus lumborum and right internal abdominal oblique.

The user may further "hike" the right aspect of his/her pelvis towards the user's rib cage while rolling ball 199 back and forth upon exercise support surface 125. Resistance to the hike may occur indirectly. The hiked leg (the leg in contact with ball 199) will press into ball 199 and in turn ball 199 presses against exercise support surface 125 (or 115). Friction between ball 199 and exercise surface 125 may cause additional resistance.

The above description of the sidebend-pelvic hike is made with reference to exercising a user's right side. A user may exercise his/her left side by merely reversing the above-described exercise. The user may perform the described movements for a desired number of repetitions for a first side, and then perform a desired number of repetitions for an alternate side. The user may also alternate back and forth between the right and left sides. A user may perform the sidebend movement, or the hip hike movement, independently or in combination.

A user may increase resistance while performing the sidebend-pelvic hike by securing an elastic resistance band to each ankle, or to the user's shoes, or otherwise. A second user may hold the other end of the elastic resistance bands to provide resistance. In the alternative, the elastic resistance bands may be coupled to a wall or other static object.

Arm Pull

Figure 18:
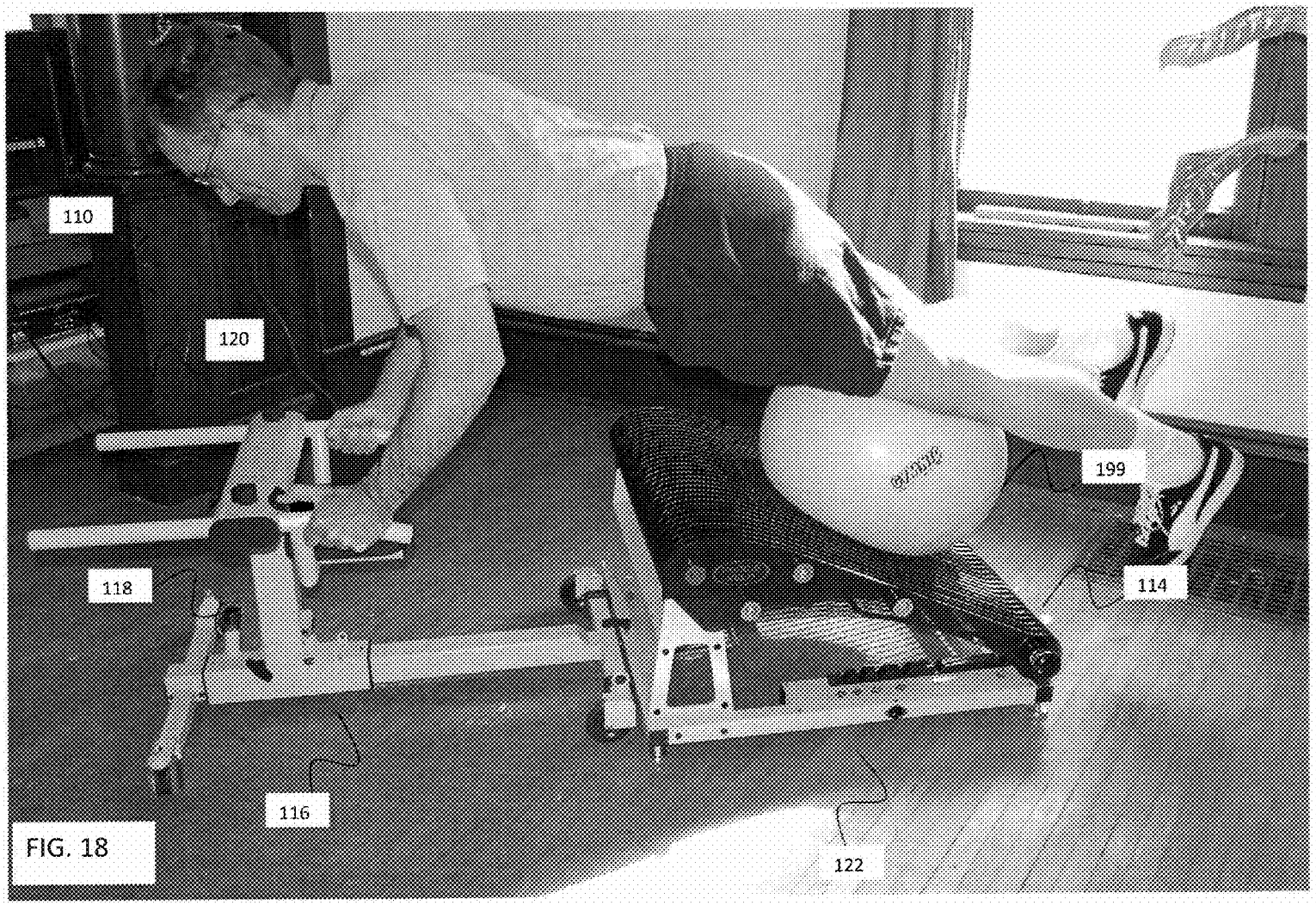
FIG. 18 illustrates a side perspective view of an exercise apparatus used to perform a forward arm pull exercise according to a second embodiment.

FIG. 18 illustrates another exercise enabled by exercise device 110, the forward arm pull. A user may position back portion 113 in position 4 with respect to front portion 111. The user may also position exercise support member 114 with generally arcuate surface 125 facing upwards.

To perform this exercise, a user may grip hand support assembly 120, position exercise ball at first end 182 of exercise support member 114, and lay flat with his or her hips resting upon exercise ball 199. The user may maintain a relatively neutral trunk and lower extremity position, while the user's shoulders may be in flexion. The user may then pull himself up the slope of exercise support surface 125 (115) and back down again for a desired number of repetitions. Preferably, the user will orient his/her shoulder blades in a position in which they are able to draw the upper trunk into stable movement during the exercise. A user may further isolate the musculature used during the forward arm pull by positioning a left or right hip upon the exercise ball.

The forward arm pull is advantageous, not only because of the benefits provided for core muscle strength, flexibility, and movement that may be translatable to cycling, but the exercise also provides a user an ability to exercise the latissimus dorsi muscles as would be traditionally accomplished via pull ups or lateral pull downs. Typical exercise equipment that facilitates these exercises requires vertical positioning. As such they are often quite cumbersome and/or take up a lot of space. Exercise apparatus 110 provides an alternative to these known exercise machines that is much more compact, while still allowing a user to exercise these muscles effectively.

In another exercise not shown in the figures, a user may perform a hip flexion exercise. This exercise is similar to the forward arm pull described above, except the user may place exercise ball 199 on exercise support surface 115 at a position near second end 183. The user will grip hand support assembly 120 with his/her knee or lower legs on the exercise ball and begin the exercise with his/her shoulders at a mid-point of flexion. The user may maintain his/her trunk at relatively neutral or in slight flexion. The user will then roll ball 199 down the exercise support surface 125 extending his/her legs using the hip flexor muscles and then pull him/herself back up the slope for a desired number of repetitions. A user may also perform the hip flexion exercise by supporting him/herself on a single knee while moving up and down exercise support surface 125.

Leg Exercises

Figure 20:
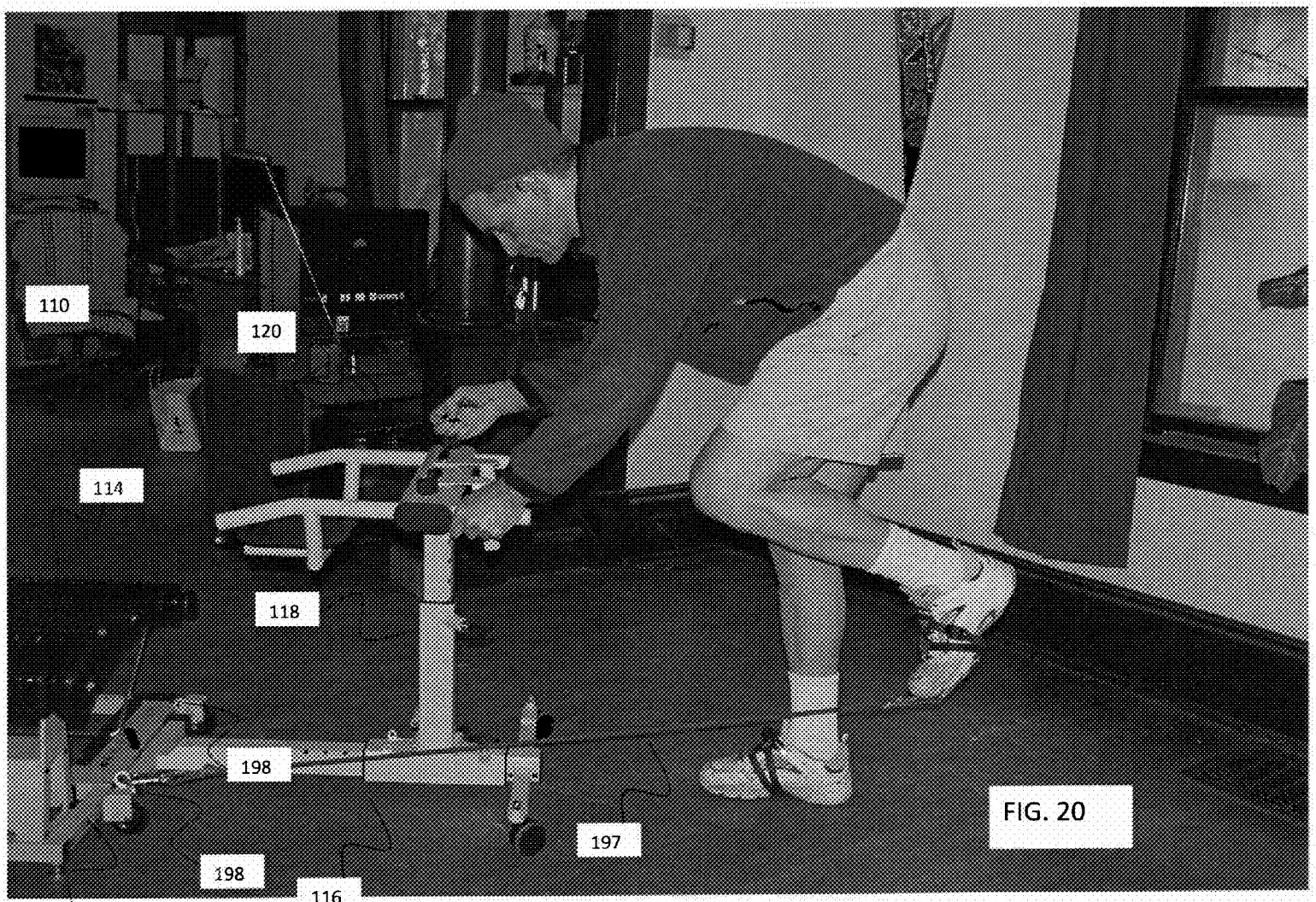
FIG. 20 illustrates a side perspective view of an exercise apparatus used to perform leg exercises according to a second embodiment.

As shown in FIG. 20, exercise apparatus 110 may be utilized to perform a variety of leg exercises without the use of exercise ball 199. To do so, a user may connect a length of exercise tubing 197 from the user's ankle or base of his/her shoe to at least one of eyelets 198. Eyelets 198 are shown secured to back support bar 132, however eyelets may be located in any other position on exercise apparatus 110.

To perform leg exercises, a user may position vertical support unit 118 at a farthest possible position from back portion 113. The user may then grip hand support apparatus 120 from a position opposed from back portion 113, and pull his/her legs in response to the resistance of the exercise band. To increase or decrease resistance, a user may also alter a position of vertical support unit 118 and hand support assembly 120 with respect to back end 113, or alter a length or tensile strength of the exercise tubing. A user may perform these leg exercises while facing away from exercise apparatus 110 (hip flexors and quadriceps muscles) or while facing exercise apparatus 110 (hip extensors or hamstrings). A user may further secure the exercise tubing at a base of the user's foot, thus enabling the user to exercise ankle control while exercising other muscles.

A user may perform leg or other exercises using exercise apparatus 110 with exercise tubing coupled at other locations than on exercise apparatus 110. For example, a user may stand facing front portion 111 and grasp hand support assembly 120. An exercise band may be attached at one end to the user's leg or foot, and at the other end to a static object (such as a wall) or another user. The user may then perform exercises against the resistance of the exercise band. One example of such an exercise is for the user to move his/her hip flexure muscles while maintaining the user's exercising leg in a stable or semi-stable position, thus focusing the exercise on the hip flexor muscles.

While the above description of exercise apparatus 10 and 110 are described in terms of exercises that are applicable to the sport of cycling, the use of exercise apparatus 10 and 110 may also be applicable to other sports such as snowboarding, skating, baseball, tennis, golf, hockey, soccer, and football, among others. Exercise apparatus 10 and 110 may in addition be advantageous to perform exercises without the goal of training sport-specific movements, because exercise apparatus 10 and 110 provides a user with a unique ability to strengthen the user's core musculature. For example, a user may utilize exercise apparatus 10 and 110 as at least part of an abdominal and/or lower back exercise routine.

Exercise apparatus 10, 110 may be included in a kit according to some embodiments. According to these embodiments, exercise apparatus 10, 110 may be provided in combination with one or more exercise balls 199 of varying size or shapes, one or more exercise bands or weights, and a variety of different coupling mechanisms for coupling the exercise bands or weights to exercise apparatus 10, 110, to a user, to one or more static objects such as a wall or door, or to another user assisting the primary user to exercise. For example, the kit may include coupling mechanisms to couple weights or exercise bands to various positions on a user's foot, or to a user's knee, calf, or any other advantageous position on a user's body. The kit may further include coupling mechanism for coupling an exercise band to exercise apparatus via eyelets 198 or attachment bars 8 and/or 28, for example.

The kit may also include training materials to instruct a user how to utilize exercise apparatus 10, 110 and accompanying equipment such as an instruction manual, a DVD or videotape, computer disk, computer multimedia material, and means to access remote electronic informational objects; and combinations thereof.

The kit may also include a plurality of exercise support members 114 to allow a user further customizability in available support surfaces 115 and 125. These exercise support members 114 may also be provided with adjustment bars 195 of varying sizes, lengths, and or shapes to allow a user further adjustability of an angle of inclination between exercise support member 114 and base 122.

Various embodiments of systems, devices and methods have been described herein. These embodiments are given only by way of example and are not intended to limit the scope of the present invention. It should be appreciated, moreover, that the various features of the embodiments that have been described may be combined in various ways to produce numerous additional embodiments. Moreover, while various materials, dimensions, shapes, etc. have been described for use with disclosed embodiments, others besides those disclosed may be utilized without exceeding the scope of the invention.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. An exercise device for isolated training of one or more musculature systems of the human body, comprising:

a front portion having a hand support assembly;

a back portion connected to the front portion, said back portion including:

an exercise support member having a first surface and a second surface and having an angle adjustment bar at a first end;

a base including four sides, a vertical support member adapted to receive a second end of the exercise support member, and an angle plate at a top surface of the base, the angle plate having a plurality of divots constructed to receive the angle adjustment bar;

at least one coupling interface presented at each of the four sides of the base, wherein each coupling interface is constructed to interface with a corresponding portion of the hand support assembly; and wherein the exercise device is constructed to enable a user to balance on an exercise ball supported by the exercise support member and grip the hand support assembly to perform exercises.

2. The exercise device of claim 1, wherein the front portion is releaseably coupled to the back portion.

3. The exercise device of claim 1, wherein the front portion includes a main bar and a vertical support unit, wherein the vertical support unit includes a first end adapted to be coupled to the main bar and a second end coupled to the hand support assembly and wherein the vertical support unit is constructed to support the hand support assembly at a vertical position with respect to the main bar.

4. The exercise device of claim 3, wherein the vertical support unit includes multiple setting and locking mechanisms to enable a user to adjust and secure a vertical position of the hand support assembly.

5. The exercise device of claim 4, wherein the vertical support unit is adjustable with respect to the main bar to enable a user to secure a longitudinal position of the hand support assembly.

6. The exercise device of claim 1, wherein the hand support assembly has at least two horizontal grip members.

7. The exercise device of claim 1, wherein the hand support assembly has at least one vertical grip member and at least one elbow support member.

8. The exercise device of claim 1, wherein a surface contour of the exercise support member is selectable by disposing the exercise support member with the first surface or the second surface facing upward with respect to the base.

9. The exercise device of claim 1, wherein the first surface of the exercise support member is a substantially flat surface, and wherein the second surface of the exercise support member is a substantially arcuate surface.

10. The exercise device of claim 1, wherein the first surface and the second surface have respective contours selected from the group consisting of:

substantially concave;

substantially convex;

substantially arcuate; and substantially flat.

11. A method of performing exercises, comprising:

selecting from among a plurality of sides of a base, said base constructed to support an exercise support member, said exercise support member disposed adjacent to a front portion that includes a hand support assembly, wherein selecting results in an angular orientation of the exercise support member with respect to the hand support assembly;

coupling a selected side of the base of the exercise support member to the front portion;

selecting from a first surface and a second surface of the exercise support member to select an exercise surface contour of the exercise support member;

disposing a first side of the exercise support member at a vertical support unit of the base;

selecting an inclination angle of the exercise support member with respect to the base by selecting a divot of a plurality of divots presented in an angle plate at an upper surface of the base;

disposing an angle adjustment bar presented at a second side of the exercise support member in the selected divot of the plurality of divots;

positioning an exercise ball on the exercise support surface; and performing exercises while positioned upon the exercise ball and gripping at least one bicycle-style hand grip presented by the hand support assembly.

12. The method of claim 11, further comprising:

adjusting a vertical position of the hand support assembly.

13. The method of claim 11, further comprising:

adjusting a longitudinal position of the hand support assembly.

14. The method of claim 11, wherein gripping the at least one bicycle-style hand grip includes gripping at least one vertically oriented hand grip.

15. The method of claim 11, wherein gripping the at least one bicycle-style hand grip includes gripping at least one horizontally oriented hand grip.

16. The method of claim 11, wherein performing exercises includes performing a trunk pelvic roll exercise.

17. The method of claim 11, wherein performing exercises includes performing a sidebend hip hike exercise.

18. The method of claim 11, wherein performing exercises includes performing a forward arm pull exercise.

19. A kit for enabling isolated training of one or more muscles of a user's body, comprising:

an exercise ball adapted to allow a user to balance upon to perform exercises;

at least one exercise band constructed to provide resistance while exercising; and an exercise apparatus, including:

a front portion having a hand support assembly;

an exercise support member including a first surface and a second surface and presenting an angle adjustment bar at a first end;

a base including four sides, a vertical support member adapted to receive a second end of the exercise support member, and an angle plate at a top surface of the base, the angle plate presenting a plurality of divots constructed to receive the angle adjustment bar;

at least one coupling interface presented at each of the four sides of the base, wherein each coupling interface is constructed to interface with a corresponding portion of the front portion; and wherein the exercise device is constructed to enable a user to balance on an exercise ball supported by the exercise support member and grip said hand support assembly to perform exercises.

* * * * *